United States Patent [19]

MacKenzie et al.

[11] 4,085,300

[45] Apr. 18, 1978

[54] FREQUENCY CONTROLLED INDUCTION COOKING APPARATUS

[75] Inventors: Raymond W. MacKenzie, Pittsburgh; Peter Wood, Murrysville; Theodore M. Heinrich, Murrysville; Robert M. Oates, Murrysville, all of Pa.

[73] Assignee: White-Westinghouse Corporation, Inc., Cleveland, Ohio

[21] Appl. No.: 682,489

[22] Filed: May 3, 1976

Related U.S. Application Data

[63] Continuation-in-part of Ser. No. 532,550, Dec. 13, 1974, abandoned.

[51] Int. Cl.[2] ..... H05B 5/04

[52] U.S. Cl. ..... 219/10.49 R; 219/10.77; 363/80; 363/98

[58] Field of Search ..... 219/10.49, 10.77; 321/18, 4, 14, 61; 323/22 T; 331/110; 363/80, 97, 98, 131, 132

[56] References Cited

U.S. PATENT DOCUMENTS

| | | | |
|---|---|---|---|
| 3,566,243 | 9/1968 | Landis | 321/18 |
| 3,596,165 | 7/1971 | Andrews | 321/18 |
| 3,781,505 | 12/1973 | Steigerwald | 219/10.77 |
| 3,806,688 | 4/1974 | MacKenzie et al. | 219/10.77 |
| 3,823,297 | 7/1974 | Cunninghan | 219/10.77 |
| 3,875,493 | 4/1975 | Kunzinger et al. | 321/18 |
| 3,886,342 | 5/1975 | Peters | 219/10.49 |
| 3,908,159 | 9/1975 | Griffey | 321/18 |

*Primary Examiner*—Bruce A. Reynolds

*Attorney, Agent, or Firm*—McNenny, Pearne, Gordon, Gail, Dickinson & Schiller

[57] ABSTRACT

The invention relates to induction heating for cooking. Solid state reciprocal power switches are used to excite a resonant power output circuit including an induction coil to be inductively coupled to a cooking utensil. A first control signal which is a function of the Q of the coil, the direct current voltage applied to the power switches and the frequency of operation of the power switches is used to offset the power circuit from oscillating at resonance in order to control the power output. A solid state differential circuit is used responsive to a second control signal establishing the level of power desired and to the first control signal for regulation about the selected power level. The same differential circuit is responsive to a third control signal to insure low starting power or in case of a failure of the power line. Minimum power output is provided at the lower end of the ultrasonic frequency spectrum without entering the audible frequency range.

4 Claims, 24 Drawing Figures

FREQUENCY CONTROLLED INDUCTION COOKING APPARATUS

CROSS REFERENCES TO RELATED APPLICATIONS

This is a continuation-in-part of application Ser. No. 532,550, filed Dec. 13, 1974 now abandoned.

The present application is related to the following patent application, which is assigned to the same assignee as the present application: Ser. No. 416,327, filed Nov. 15, 1973, by R. W. MacKenzie, now issued as U.S. Pat. No. 3,889,090.

BACKGROUND OF THE INVENTION

The invention relates to solid state electronic induction heating for cooking, and more particularly to transistor apparatus for such purpose.

It is known from U.S. Pat. No. 3,806,688, issued Apr. 23, 1974 in the name of the same assignee as the assignee of this application, to generate eddy currents at ultrasonic frequency in a metallic utensil for cookware. The heating coil used is part of a resonant inductance-capacitance circuit maintained at resonance by a transistor oscillator driven by feedback from the resonant circuit. The patent also teaches control of the power fed from the chopper to the heating coil by a control signal representing the excursions of the resonant voltage at the coil beyond the direct current voltage applied to the chopper. The DC voltage is automatically adjusted to meet the pan temperature as required by the user.

Induction cooking offers many advantages over conventional cooking, such as the electric range. The most typical advantages are safety for the user and a more efficient transfer of energy from the heating spiral to the cooking utensil. However, induction cooking requires sophisticated electronic equipment and such added sophistication must be matched in terms of cost and reliability with the more simple technique of conventional ranges. Therefore, the merit of induction cooking from an industrial and commercial point of view resides essentially in the basic design of the circuitry, the ruggedness of the construction, the relative simplicity of the solid state arrangement and the choice of the constructive elements.

The technique applied according to the description in the U.S. Pat. No. 3,806,688 is attractive from this point of view since transistors are used instead of thyristors. Transistors can be turned off by the control electrode, whereas thyristors must be forced off by bringing the anode current to zero. Besides a gating circuit is not required for timing the conduction periods of a transistor. As described in the patent, the resonant heating coil itself is used by feedback to alternately switch one transistor at a time when the collector current of the other passes by zero. Also, power control is provided by a feedback loop around the transistors for adjusting the DC voltage applied to the transistor oscillator in accordance with the excursions of the resonant voltage beyond the applied DC voltage. The latter constitutes an excellent indicator of the relation existing on the heating coil between the voltage supplied from the DC line and the energy drawn by eddy currents in the cooking utensil. However, cost reduction makes it desirable to provide a more compact circuitry for the control loop.

The object of the present invention is to provide an improved induction cooking apparatus.

Another object of the present invention is to provide improved power control for solid state induction cooking apparatus normally operating at or near resonance.

A further object of the present invention is to provide a frequency controlled induction cooking apparatus.

SUMMARY OF THE INVENTION

The invention provides a novel and unique solid state induction heating cooking range. Low cost, compactness, safety of operation and efficiency are obtained by frequency control as a function of the Q of the heating coil, the direct current voltage applied to the power switches and the frequency of operation of the power switches, generating ultrasonic power output to the cooking utensil. A solid state differential circuit is used responding both to a manual control signal determining the power level of operation and to the regulatory control signal which is derived in a single feedback loop combining automatic adjustment of the power supplied to the load in case of load variation or of change in the power supply lines. The same solid state differential circuit responds to a third overriding signal for establishing low power when starting. Minimum power is provided beyond the range of frequency control by solid state circuitry.

GENERAL CONSIDERATIONS RELATIVE TO THE INVENTION

The principle of induction heating has been applied to industrial hardening of metallic parts for over fifty years. The use of induction heating for cooking is likewise old as evidenced by U.S. Pat. No. 891,657 of A. F. Berry, dated June 23, 1908.

The concept of induction heating is based on the observation that an alternating magnetic field causes a voltage to be induced in a conductor inductively coupled to the magnetic field. The voltage so induced gives rise to a current which causes joule dissipation in the conductor. The earliest prior art used line frequency (60 Hz) to create the alternating magnetic field. This is the easiest way since only a coiled wire and a core are needed. There are however, some disadvantages to this approach. First, the sizes of the coil and the core are, to a first approximation, inversely proportional to the frequency of excitation and therefore the field producing elements tend to be large at such low frequency of 60 Hz. Secondly, the size of the cooking utensil must also be larger at lower frequencies. Furthermore, the pan is alternately attracted by, and repelled from, the coil with an audible noise which can become extremely unpleasant. For these reasons, the earlier attempts at induction cooking at power line frequency have failed, and operation at ultrasonic frequencies has since become the better practice. This solution, however, required the use of a power oscillator in order to excite the coil, and special circuitry for which solid state technology was a natural choice.

Figure 1:
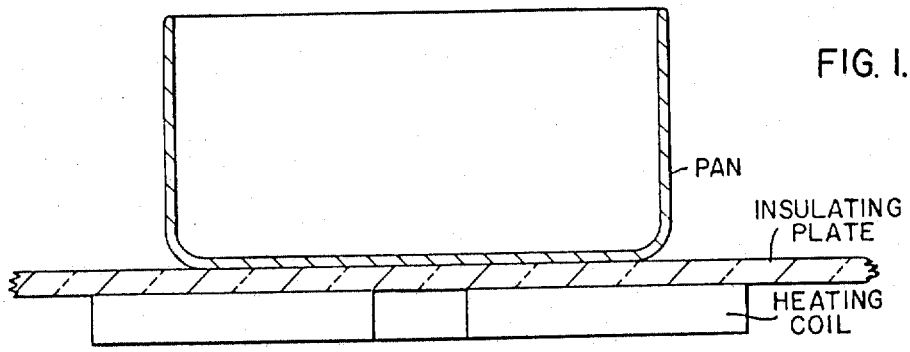
FIG. 1 illustrates a heating coil with an insulating plate providing a cool top and a cooking utensil disposed thereon.

In order to understand the consequences of such increased frequency and its effect on the materials which are used for the saucepan, a qualitative understanding of the induction heating process is necessary, as follows:

FIG. 1 shows a coil, commonly called a work coil, which is used to produce the alternating magnetic field and a cooking utensil which is placed as close as possible to the work coil in order to enhance inductive coupling between the work coil and the bottom of the utensil. The work coil may be wound with many turns of fine wire, but even a single turn can suffice, depending on voltage and frequency. Whatever the number of turns, the ampere-turns of the work coil induce a proportional amount of ampere turns (depending on the exact value of the coupling coefficient) into the bottom of the utensil. In fact, the utensil can be considered as a single short ampere turn. The current circulating in the bottom of the utensil causes power dissipation which is directly used to heat the food. For reasons of efficiency and cooling, such power dissipation in the pan should be as high as possible while the power dissipation in the work coil must remain as low as possible. Since the ampere-turns in the work coil and in the bottom of the pan are nominally the same, the efficiency is approximately:

$$Eff = (R_{pan}/R_{pan} + R_{coil}) \times 10^2\% \quad (1)$$

assuming a coupling coefficient of unity.

Equation (1) shows that in order to have a high efficiency the coil resistance $R_{coil}$ must be much smaller than the effective pan resistance $R_{pan}$. At first glance, aluminum or copper, are not the ideal materials for the utensil because of their intrinsically low resistivity. Still, not only the resistivity, but also the distribution of the current in the bottom of the utensil must be taken into consideration, since at high frequency the "skin effect" occurs due to the interaction of the current and the magnetic field causing the induced current to be confined at the lower surface of the saucepan. The depth at which current density reaches $e^{-1}$ (37%) of the surface current density is given by the equation:

$$\delta = 3160\,(p/f\mu)^{\frac{1}{2}} \quad (2)$$

where $\delta$ = skin depth (inches)

$f$ = frequency (hertz)

$\mu$ = initial permeability (relative to free space)

$p$ = resistivity (ohm-inches)

The skin depth for various materials at 24 kHz and at 60 Hz is shown in Table I.

TABLE I

SKIN DEPTH OF SELECTED MATERIALS AT 24 kHz

| Material | $\rho$ (Ohm-Inches) | $\mu$ (Initial) | Skin Depth at 60 Hz/24 kHz (Inches) | Surface Resistivity at 24 kHz (ohms) |
|---|---|---|---|---|
| 1010 Steel | $9.0 \times 10^{-6}$ | 200 | .08/.004 | $2.25 \times 10^{-3}$ |
| 432 S.S. | $24.5 \times 10^{-6}$ | 200 | .14/.007 | $3.5 \times 10^{-3}$ |
| 304 S.S. | $29 \times 10^{-6}$ | 1 | 2.24/.112 | $2.59 \times 10^{-4}$ |
| Aluminum | $1.12 \times 10^{-6}$ | 1 | .44/.022 | $5.10 \times 10^{-5}$ |
| Copper | $0.68 \times 10^{-6}$ | 1 | .34/.017 | $4.0 \times 10^{-5}$ |

From the point of view of dissipation, it can be shown that plates having a thickness of more than three or four skin depths can be regarded as if they were only a skin depth thick and having a resistivity which is the same as the DC resistivity.

The resistance of a strip, one unit wide and one unit long is:

$$R_s = \rho/\delta \text{ ohms} \quad (3)$$

Substituting for $\delta$ from equation (2):

$$R_s = 3.16 \times 10^{-4} (\rho f \mu)^{\frac{1}{2}} \text{ ohms} \quad (4)$$

$R_s$ is called the surface resistivity and may be considered as the effective AC resistivity of the material. Table I shows typical skin depths and surface resistivities for various materials. From Equation (1) it is seen that the resistance of the pan should be large in comparison with the resistance of the coil. Since the coil usually is of copper or aluminum, it is apparent that for thick pans, the bottom of the pan preferably should be restricted to 1010 cold rolled steel, or 432 stainless steel. Having chosen the material for the bottom of the pan, Equation (4) indicates that the frequency should be selected as high as possible. However, in practice the transistors and thyristors which are used to generate power at a high frequency impose some constraints. Also, the power line used to supply energy to the oscillator has a frequency fixed at 60 Hz whereas the oscillator must operate at least at an ultrasonic level e.g. above 20 kHz. There are requirements to be met for the oscillator such as (a) a capability of operation with a.c. input voltages in the range of 200 through 260 volts, and 60 Hz (b) an output power sufficient to provide a performance comparable to a conventional 8 inches diameter "corox" resistance heater, (c) continuous power control down to 5% of the maximum output level and (d) all the applicable FCC requirements must be met.

There are many circuits possible using transistors or thyristors. However, mass production of power transistors for TV sweep circuits and automobile ignition systems, has made them available at low cost. The above-mentioned U.S. Pat. No. 3,806,688 shows a practical circuit using transistors. A transistorized oscillator in the patent is associated with a series resonant half-bridge, a configuration which results in reduced semiconductor stresses. The same configuration has been used for the preferred embodiment according to the present invention.

THE SERIES RESONANT POWER CIRCUIT

Figure 2:
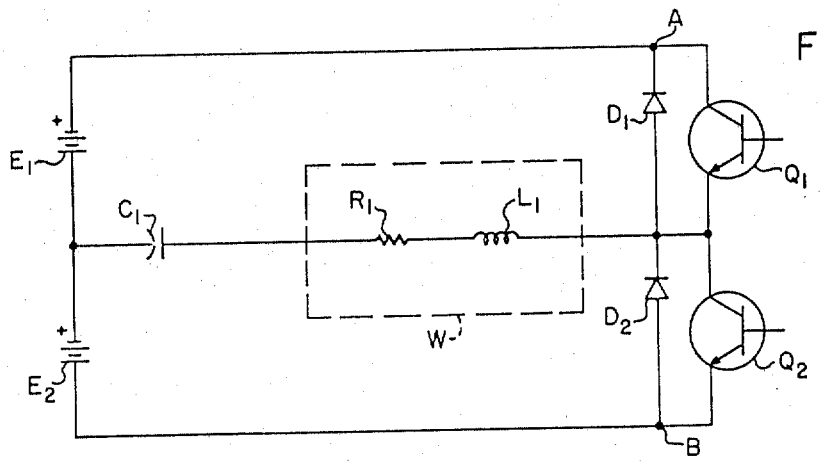
FIGS. 2 and 3 show the series resonant power circuit including the heating coil mounted in a half bridge configuration in the split supply and in the split capacitor arrangement respectively.
Figure 3:
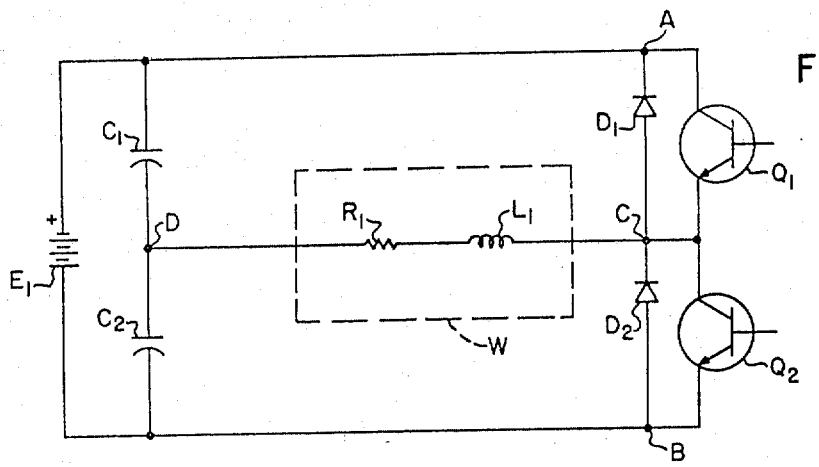

FIGS. 2 and 3 show two variations of the half-bridge resonant circuit. FIG. 2 shows two serially connected DC sources $E_1$, $E_2$, of the same voltage E having a junction point connected to one end of a resonant circuit comprising a capacitor $C_1$ (capacitance C) and a work coil W including an inductor $L_1$ (inductance L) and a resistor $R_1$ (resistance R). The other end of the resonant circuit is connected to the junction point between serially connected transistor switches $Q_1$, $Q_2$. Each transistor is provided with an antiparallel diode $D_1$ or $D_2$. Transistors $Q_1$, $Q_2$ alternately switch current, at A or B, from the associated DC source $E_1$, $E_2$ to the resonant circuit. The circuit of FIG. 3 is equivalent to the circuit of FIG. 2. Here two capacitors $C_1$, $C_2$ are mounted so as to introduce in circuit a split capacitance of value C/2 between a common DC source $E_1$, of twice the voltage E of the sources $E_1$, $E_2$, in the previous circuit. In each instance, the work coil W is the heating coil placed under the cookware utensil. It has an inductance L. Being inductively coupled with the cooking utensil, eddy currents are generated which appear from the power side as a resistivity component represented by resistor $R_1$, assuming the inherent resistance of the heating coil proper to be small in comparison.

Considering FIG. 2, for the sake of illustrating the operation of the circuit transistors $Q_1$ and $Q_2$ are operated as power switches, e.g. conduction occurs near saturation. Moreover, the transistors are operated in a complementary manner so that the voltage produced between points A and B is a square wave of magnitude E and frequency $f$. The heating coil W represented by an inductance-resistance series network L-R, is connected in series with capacitance C so as to form a series resonant load LRC which is the power circuit for the overall circuitry. The resonant frequency $\omega_o$ can be defined by the conventional equation:

$$\omega_o = 1/\sqrt{LC} \quad (5)$$

Assuming, for analysis purposes, that there are no losses in the oscillator, the power delivered to the cooking pan may be represented by $(i)^2$, where $i$ is the coil current. The Q factor of the circuit may be defined at resonance as $Q_o$, as:

$$Q_o = \omega_o L/R$$

The value of $Q_o$ is a very complex function depending on the position of the pan relative to the coil and on the work coil general geometry. In practice, it has been found that the range of $Q_o$ extends between 2 and 3 when the pan is in cooking position, hereinafter designated "$Q_o$(LOADED)", and between 30 and 100 when the pan is completely removed from the coil, hereinafter designated "$Q_o$(UNLOADED)".

Since the voltage driving the series resonant circuit is non-sinusoidal, it is necessary to break the voltage function into its Fourier series in order to analyze the harmonics. The square wave voltage may be represented as follows:

$$e(t) = \frac{4E}{\pi} (\sin\omega t + \frac{1}{3} \sin 3\omega t + \ldots \frac{1}{n} \sin n\omega t) \quad (6)$$

where $\omega = 2\pi f$

The coil current may be written as:

$$i(t) = I_{m1} \sin(\omega t - \alpha_1) + I_{m3} \sin(3\omega t - \alpha_3) + \ldots + I_{mn} \sin(n\omega t - \alpha n) \quad (7)$$

It can be seen that the peak current for each harmonic varies with the frequency as follows:

$$I_{mn} = \frac{\frac{4E}{\pi n}}{\sqrt{\left(n\omega L - \frac{1}{n\omega c}\right)^2 + R^2}} \quad (8)$$

and that the phase angle between an harmonic current and its corresponding voltage is given by the following equation:

$$\alpha_n = \cos^{-1}\left[\frac{R}{\sqrt{\left(n\omega L - \frac{1}{n\omega c}\right)^2 + R^2}}\right] \quad (9)$$

where for $n\omega < \omega_o$ current leads voltage; for $n\omega > \omega_o$ current lags voltage, and for $n\omega = \omega_o$ current is in phase with voltage —

Figure 4:
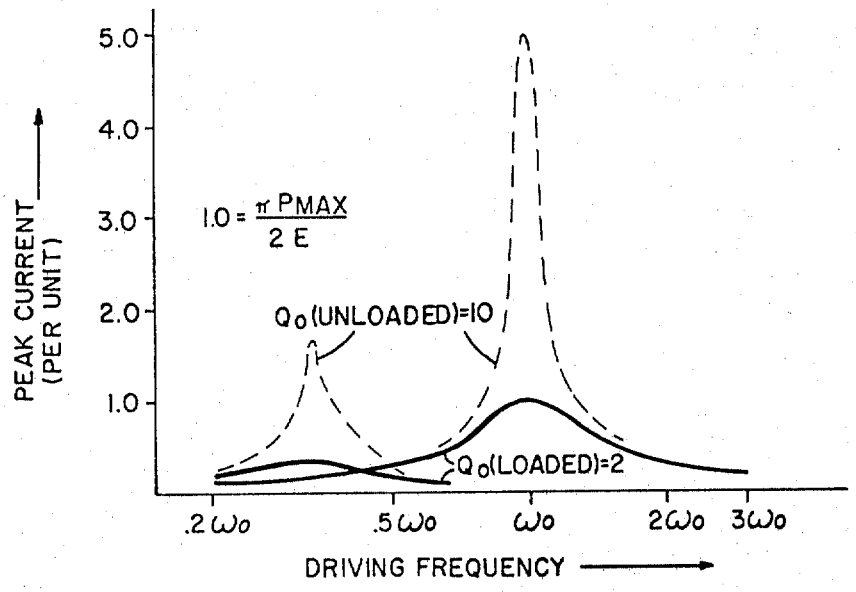
FIG. 4 provides a curve representation of peak current vs. driving frequency as used for control in the apparatus according to the present invention.

Using the preceding relationships, the parameters have been plotted in FIG. 4 as a function of frequency in the particular situation when the circuit of FIG. 2 is applied to induction cooking. The values of L, R and C must be known in terms of the desired power output, the operating voltage E, and the circuit Q. If $P_{max}$ is defined as the average power created by the fundamental component of current at resonance when the cooking pan is in place, then $$P_{max} = \frac{(e_1 RMS)^2}{R} = \frac{\frac{4E}{\pi\sqrt{2}}}{R} = \frac{8E^2}{\pi^2 R} \quad (10)$$

or, $$R = \frac{8E^2}{\pi 2 P_{avg}}. \quad (11)$$

For operation at a particular resonant frequency $\omega_o$, and for a "pan on" value of $Q_o$ equal to $Q_o$(LOADED), L is determined by $$L = R\,Q_o(\text{LOADED})/\omega_o \quad (12)$$

It follows that:

$$C = 1/L\omega_o^2 \quad (13)$$

At resonance, since the fundamental current and voltage are in phase, the fundamental peak current may be derived from the following equation:

$$I_{m1} = \frac{\sqrt{2}\,P_{max}}{e_2 RMS} = \frac{\sqrt{2}\,P_{max}}{\frac{4E}{\pi\sqrt{2}}} = \frac{\pi P_{max}}{2E} \quad (14)$$

From this relationship, it appears that the coil current under "pan on" operative conditions, is not dependent on the Q ($Q_o$(LOADED)) which can be achieved for the circuit.

A plot of normalized peak current vs. driving frequency obtained from the above relationship is also shown in FIG. 4 for the case of a "pan on" condition, where $Q_o$(LOADED) = 2. As can be seen, the fundamental current is unity at resonance, and it decreases symmetrically on either side of resonance. The third harmonic current reaches a maximum peak of 0.33 when $\omega = \frac{1}{3}\omega_o$.

If the cooking pan is removed from the coil the Q factor of the circuit increases substantially. Removal of the load has little effect on L and C, since the value of L increases only by a factor of about 1.5 when the pan is removed. Therefore, referring to Equation (12), the series resistance is modified as follows:

$$R' = \frac{\omega Q_o(\text{LOADED})}{Q_o(\text{LOADED})} = R\,\frac{\omega Q_o(\text{LOADED})}{Q_o(\text{UNLOADED})} \quad (15)$$

This is the relationship used to plot $I_{mn}$ in accordance with Equation (8) as indicated in FIG. 4 for $Q_o$(UNLOADED) = 10. As can be seen, when the pan is removed, the peak current at resonance is increased by a factor equal to the ratio of Q (UNLOADED) to Q (LOADED). In practice the peak current may become as much as 50 times the normal current. Therefore, there is a need for some form of control in order to keep the current within limits whenever a "pan off" condition occurs.

Figure 5:
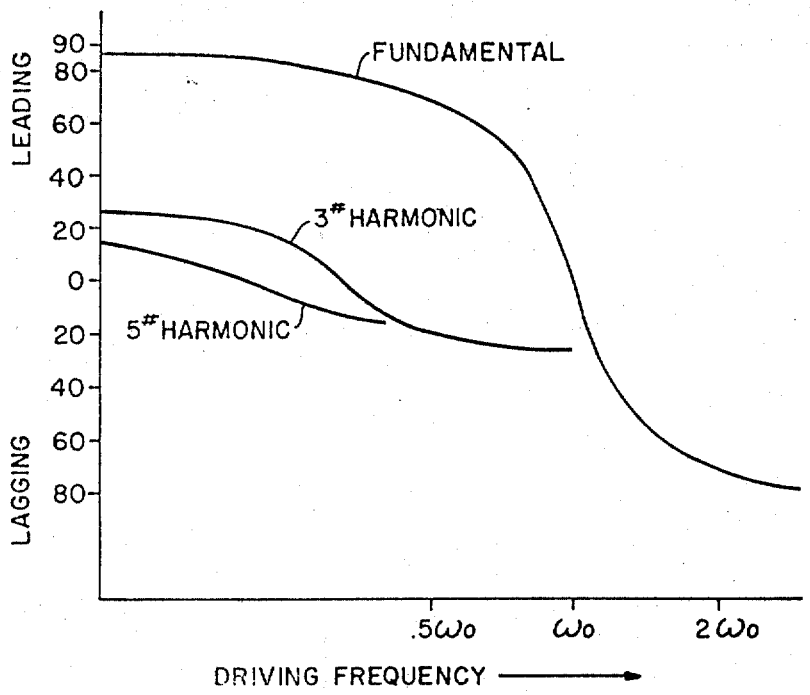
FIG. 5 shows the phase angle plotted as a function of driving frequency as an aid in understanding the operation of the apparatus according to the invention.
Figure 6A:
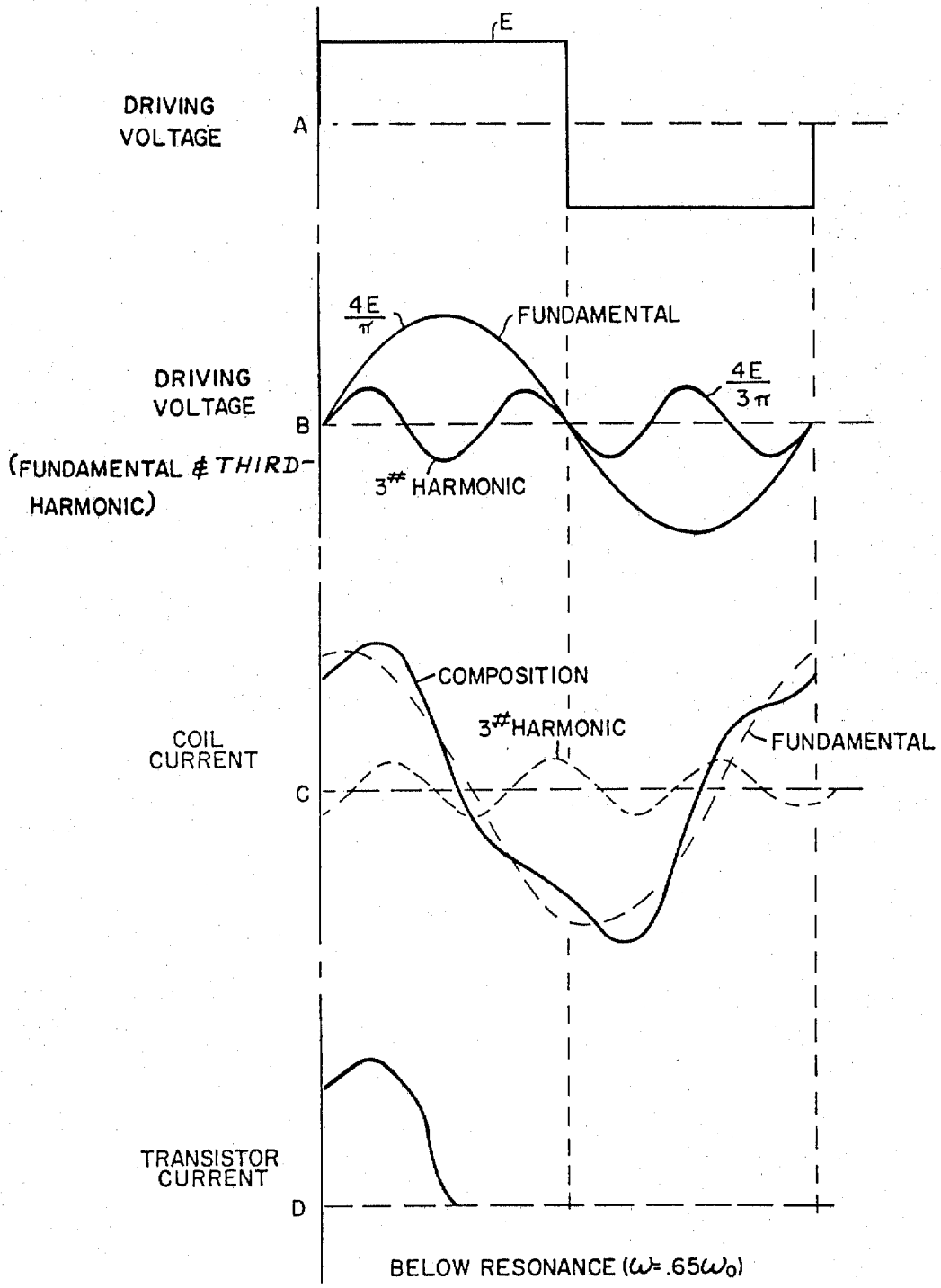
FIG. 6A is a diagram representation of the voltage driving the heating coil, the voltage driving the power switches and the coil and transistor currents when operative below resonance.

The harmonic content and phase relationship of the coil current are important factors because they have a direct bearing on the transistor switching stresses. FIG. 5 shows a plot of the phase angle (in terms of the fundamental) of each harmonic current with respect to the corresponding harmonic voltage, plotted in accordance with Equation (9). As can be seen, the fundamental current is leading below resonance, and lagging above resonance. FIG. 6A depicts by reference to the driving voltage (curve A) the coil current (curve C) and the current passing through one transistor (curve D) for operation below resonance in relation to both the fundamental and the third harmonic of the driving voltage (curve B). It is observed that the transistor is forced to turn on current, but the collector current has already gone to zero at a time prior to when the device must be turned off. Since this is the case, it is obvious that a naturally commutated device such as an SCR, could be used instead of a transistor.

Figure 6B:
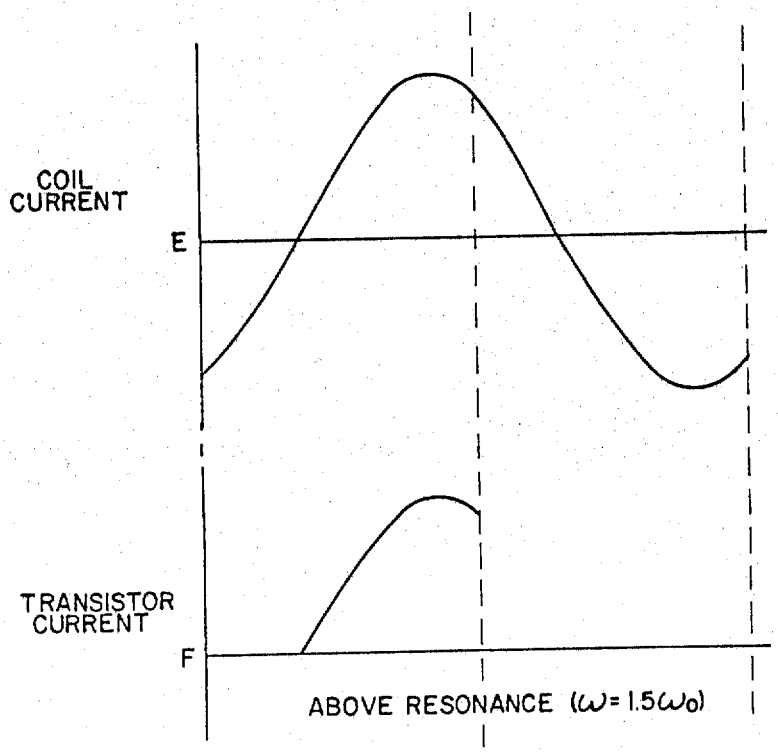
FIG. 6B shows the coil and transistor currents for the power switches operating above resonance.
Figure 6C:
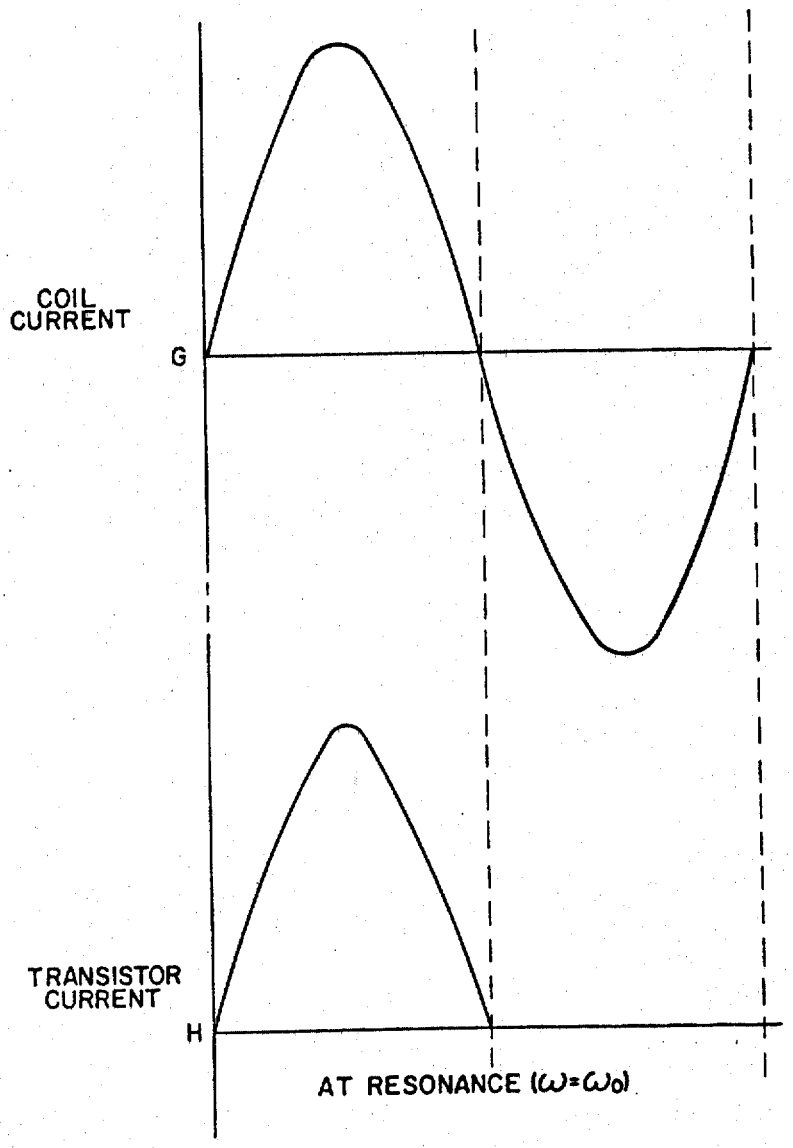
FIG. 6C shows the coil and transistor current at natural resonance.

FIG. 6B shows the coil current (curve E) and the transistor current (curve F) in the case of operation above resonance. FIG. 6C shows the coil current (curve G) and the transistor current (curve H) when operating at resonance. Harmonic currents in the latter case have been neglected because they are small in magnitude. At resonance, the transistor current is nearly a perfect half-sinewave, and the device does not have to turn on nor to turn off, current. This is an ideal situation since it implies low switching losses. Above resonance, there is no current when the transistor turns on, but the device easily turns off current, whereas in this case an SCR would not be used.

Considering power requirements, the power transferred into the cooking pan is the sum of the components of power due to the respective harmonic currents. Because the coil current involves only a fundamental frequency and the harmonic frequencies it is possible to write the following expression for the RMS current at a particular driving frequency:

$$I_{RMS} = \sqrt{\left(\frac{I_{m1}}{2}\right)^2 + \left(\frac{I_{m3}}{2}\right)^2 + \ldots + \left(\frac{I_{mn}}{2}\right)^2} \quad (16)$$

The average power may then be expressed by $$P = I_{RMS}^2 R. \quad (17)$$

Figure 7:
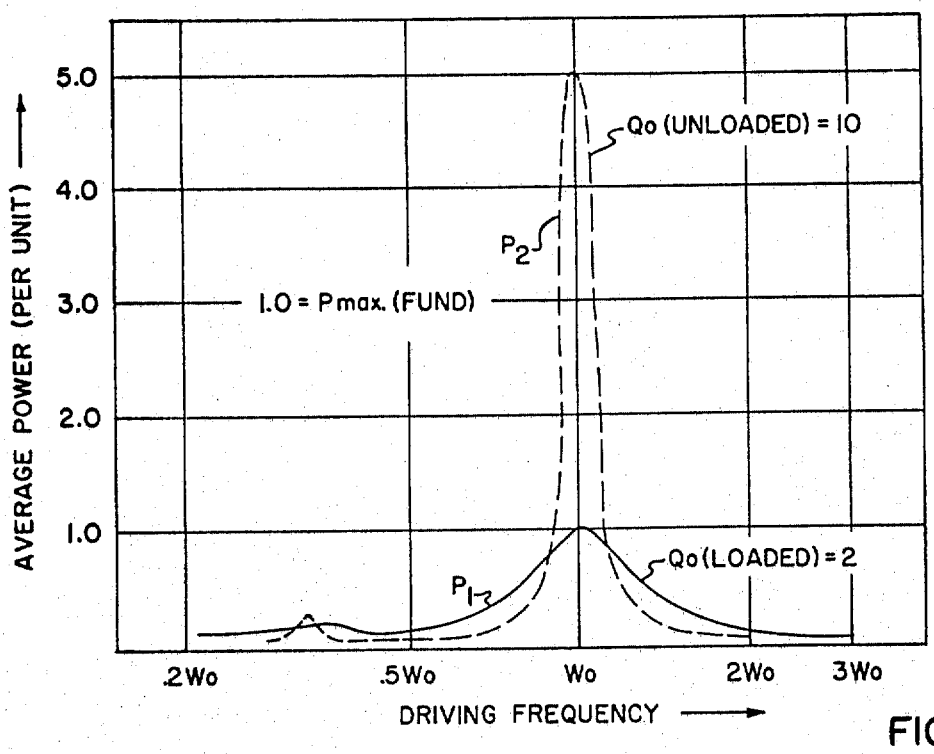
FIG. 7 provides wave comparison between the average power as a function of the driving frequency for the loaded and for the "pan off" condition.

Using these equations, curves representing normalized average power vs. driving frequency have been plotted in FIG. 7 for a constant input voltage E.

Curve $P_1$ corresponds to work coil loaded: $Q_o$ (LOADED). Curve $P_2$ is for the unloaded work coil: $Q_o$ (UNLOADED). In reality, the circuit is never permitted to run unloaded near resonance at full input voltage, as explained earlier. Considering curve $P_1$ for the loaded work coil, it appears that power does not decrease as rapidly below resonance as it does above resonance. This is due to the contribution of the harmonic currents.

It has been seen that neither the ratio of coil current nor transistor current to output power are affected by the Q factor of the coil in the load condition ($Q_o$ (LOADED)). A particular Q is obtained for a given coil geometry, and a given pan positioning or spacing. However, the Q factor in the unloaded condition has an effect on the coil and the capacitor voltage. At resonance, the peak voltage as seen across the coil or the capacitor, (considering only the fundamental) is given by:

$$V_{pk} = I_{ml}\omega_o L = \frac{I_{ml}}{\omega_o C} \quad (18)$$

Substituting into this equation the values of R, L and $I_{ml}$ obtained from equations (11), (12) and (14), it follows that:

$$V_{pk} = (4E/\pi)\, Q_o(\text{LOADED}) \quad (19)$$

This means that the voltage across the work coil, or the capacitor of the resonant circuit, is directly proportional to the Q factor for the unloaded condition: $Q_o$ (UNLOADED).

Figure 8:
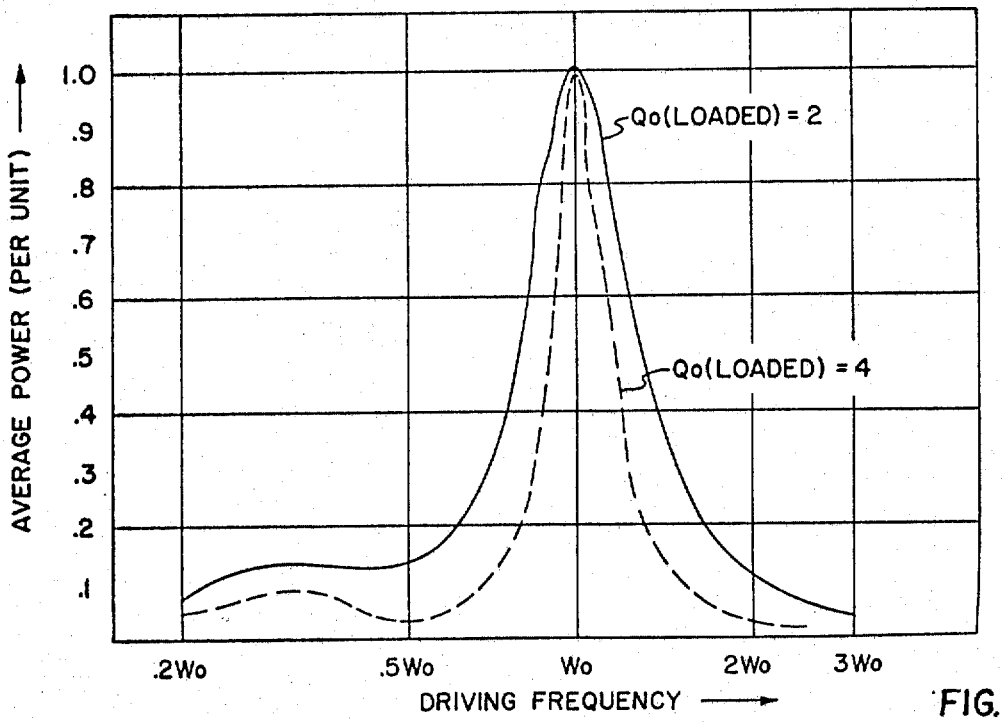
FIG. 8 shows the average power as a function of the driving frequency for two different values of the Q under loaded condition.

Another effect of such condition $Q_o$(UNLOADED), can be seen from the shape of the curve of power as a function of frequency. In FIG. 8, the average power is plotted against the driving frequency for two different values of $Q_o$(LOADED). As can be seen, higher values of $Q_o$ cause the power, and also the current, to fall off more rapidly with a change in frequency. However, as earlier mentioned, it is necessary to operate at low Q. Therefore, FIG. 8 shows that frequency control will be more difficult.

From the preceding considerations, it is concluded that the half-bridge with a series resonant load can be operated on either side of resonance. While at resonance, the semiconductors are not required to switch any current, and the means for controlling the switching of each transistor may be achieved quite easily. If the oscillator frequency is forced to vary below or above resonance, the transistors must either turn on, or turn off, current. In each instance, the power to the pan and the currents under unloaded conditions can be controlled by pulling away from the resonance. These are basic concepts which are necessary for an understanding of the problems solved by the induction cooking apparatus according to the present invention, which will be described hereinafter with particularity.

DESCRIPTION OF THE INVENTION

The invention will now be described by reference to FIG. 9 in which the half-bridge of FIG. 3 is easily recognizable by its elements. The half-bridge is fed from a constant D.C. supply developed between terminals A and B by a full wave rectifier bridge supplied by a 240 volt, 60 hertz, alternating current source 1. The output of the bridge 2 is connected to a capacitive filter including serially connected surge limiting resistor $R_3$ and parallel connected capacitor $C_3$. The circuit of FIG. 9 also includes a power oscillator 3 comprising switching power transistors $Q_1$, $Q_2$ serially connected between opposite D.C. terminals A and B. Parallel connected diodes $D_1$ and $D_2$ are associated with transistors $Q_1$ and $Q_2$ respectively. Two capacitors $C_1$ and $C_2$ are also connected in series between terminals A and B. Two junction points C and D are so defined between transistors $Q_1$, $Q_2$ and capacitors $C_1$, $C_2$, respectively. Between junction points C and D is mounted the work-coil W which is used as a induction heating coil for cooking, as previously explained by reference to FIGS. 2 and 3. As described in the aforementioned U.S. Pat. No. 3,806,688, the two transistors $Q_1$, $Q_2$ are alternately driven into conduction by the power circuit at or near resonance. To this effect a feedback transformer is used having a primary winding $T_{1c}$ coupled to secondary windings $T_{1a}$, $T_{1b}$. By regenerative feedback, when the collector current goes to zero on one transistor, the resonant circuit generates a driving current on the base electrode of the opposite transistor which starts conducting when the other is cut off. As a result, power oscillator 3 is operating without substantial switching losses. A similar transistorized power oscillator has also been described in the U.S. Pat. No. 3,596,165 of Andrews, for industrial application in a DC/DC converter.

Unlike the power oscillator described in the aforementioned U.S. Pat. No. 3,806,688, the power oscillator 3 of FIG. 9 operates from a relatively constant D.C. input voltage and instead of varying the D.C. input voltage, it is the frequency of the oscillator which is varied for power control by offset from resonance as explained hereinafter. FIG. 4 and FIG. 7 show that the output current and the average power can be varied by forcing the half-bridge to oscillate either higher, or lower, than the natural resonant frequency of the output power circuit.

Figure 9:
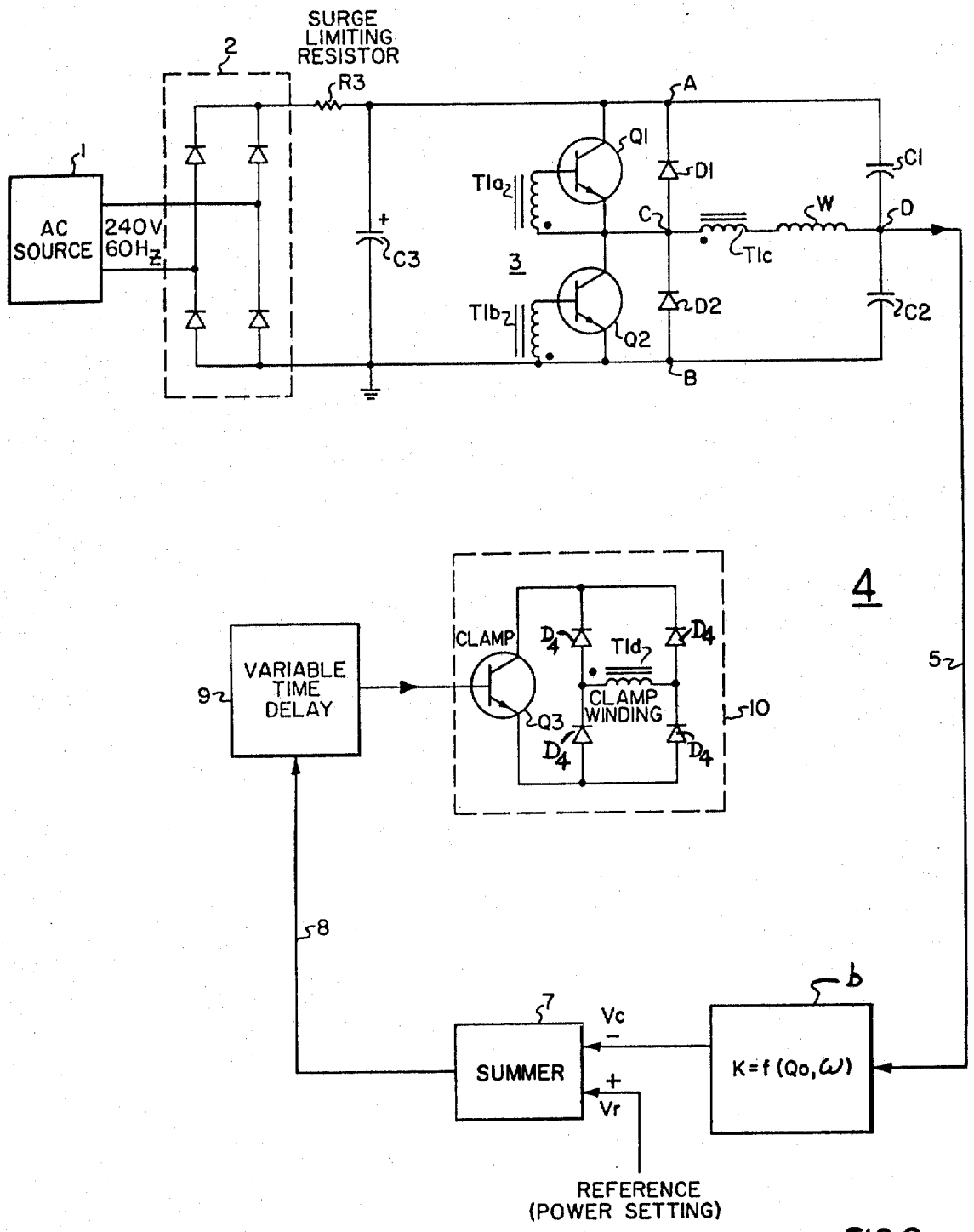
FIG. 9 is a diagrammatic representation of the power circuit and the control loop according to the present invention.

The circuit of FIG. 9 presents two original features which will be discussed with particularity hereinafter. The first feature, as earlier mentioned, resides in the fact that the resonant power circuit includes a heating coil used in association with a pan for cooking. The second feature which will be now considered more specifically, consists in a single feedback loop 4 which is being provided both in order to lower the power into the pan under loaded conditions, and to limit the coil current under unloaded conditions (it being understood, as well known in this particular art, that the apparatus is loaded when there is a pan coupled with the heating coil, and that it is unloaded when the pan has been removed from the work coil while there is a supply of energy from the power supply).

The controlled variable is a voltage $V_c$ proportional to the peak of the storing of the capacitor voltage in the resonant power circuit above the D.C. input voltage appearing between terminals A and B. This control voltage is compared with a reference voltage $V_R$ (power setting) set by the user on the range. The resulting error signal is used as a control signal in order to maintain $V_c$ equal to $V_R$.

Figure 10A:
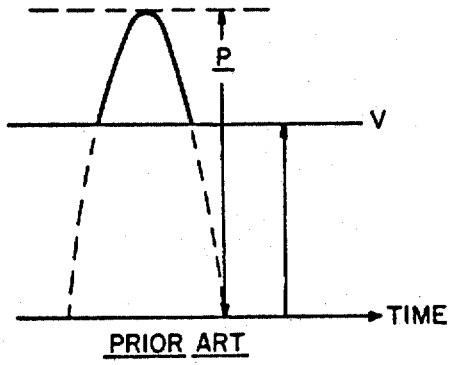
FIGS. 10A, 10B, shows voltage control as a result of a change in the power setting in the prior art.
Figure 10B:
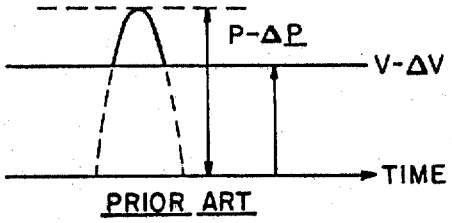
Figure 11A:
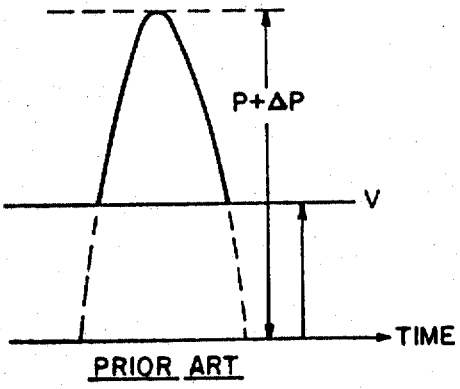
FIGS. 11A, 11B show how, voltage control in the prior art responds to an excessive Q of the coil, and keeps power constant.
Figure 11B:
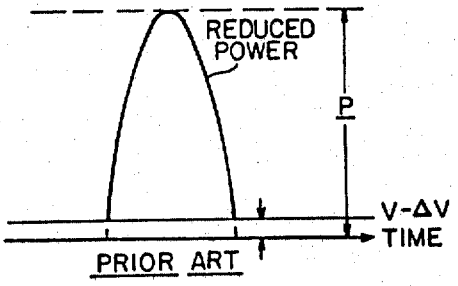
Figure 12:
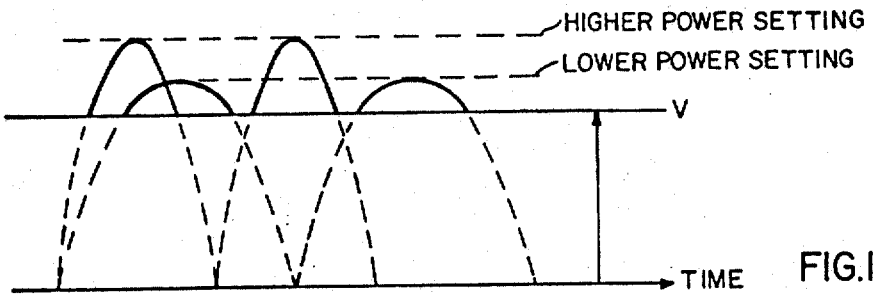
FIG. 12 shows frequency control in accordance with the present invention for two different power settings.
Figure 13:
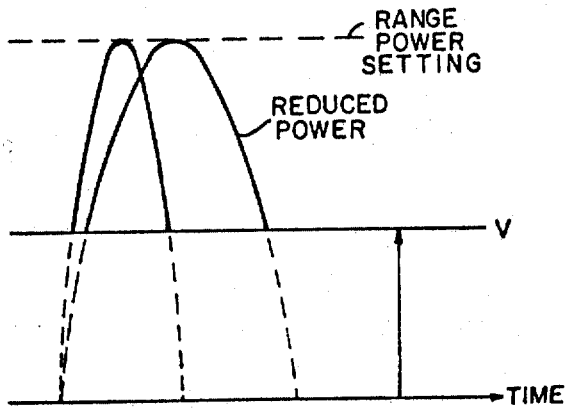
FIG. 13 shows automatic control in accordance with the present invention, when an excessive Q occurs.

It is important here to make a comparison between the control operation of the apparatus described in U.S. Pat. No. 3,806,688 and the control operation of the apparatus according to the present invention. FIGS. 10A and 10B show how the control signal of the prior art is used for adjusting the D.C. voltage supplied to the power oscillator in order to regulate the power output in accordance with a different power setting. FIGS. 11A, 11B show the same control signal used for containing the oscillator currents for a given power setting (reference voltage $V_R$) despite a change in the Q of the coil when the pan is removed, at least partially, from the orbit of the heating coil. In contrast FIGS. 12 and 13 illustrate power control in accordance with the present invention. A control signal is derived for adjusting the frequency and therefore the power output at a desired level ($V_R$). FIG. 12 shows control for two different power settings and FIG. 13 illustrates operation for a given power setting (reference, $V_R$), by frequency adjustment when the Q of the work coil has changed. A feedback loop 4 is used, as shown in FIG. 9, in order to provide power control as represented by FIGS. 12 and 13. From the power circuit comprising the work coil W and capacitors $C_1$, $C_2$ is derived a control signal $K = f(Q_o, \omega)$ where $Q_o$ is the Q of the coil at resonance and $\omega$ the frequency of the power circuit when offset from resonance. The control signal represents the excursion corresponding to $V_c$, the swing of the peak in the power circuit beyond the D.C. input voltage applied to the resonant network between points A and B. In the aforementioned U.S. Pat. No. 3,806,688 diodes were used in combination with a feedback transformer in order to detect such voltage $V_c$ selected as typical of the output power transferred into the pan from the work coil. The derviation of the control signal in the present invention is schematically represented in FIG. 9 by line 5 from junction point D, which is inputted in a block 6 having a transfer function $K = f(Q_o, \omega)$ from which is derived an input signal $V_c$ fed to a summer 7 where it is compared with a reference signal $V_R$ in order to generate an error signal. This error signal is applied via line 8 to a variable time delay 9 which determines the initial time of conduction of transistor $Q_1$, or $Q_2$ after zero-crossing when it is applied to a clamping circuit 10. Clamping circuit 10 includes a clamp transistor $Q_3$ having a base electrode controlled by the variable time delay 9, and a clamp winding $T_{1d}$ associated with the control windings $T_{1a}$ and $T_{1b}$ of transistors $Q_1$, $Q_2$ respectively. Operation of such clamping circuit 10 and variable time delay 9 is similar to the one described in U.S. Pat. No. 3,596,165 of Andrews. Andrews also uses delayed conduction of the transistors to offset oscillation resonance below resonance, in order to vary the D.C. voltage output of a DC/DC converter. To this effect clamping of the oncoming transistor of the power oscillator is used in order to delay, for a controlled time interval, the instant of conduction, thereby to decrease the frequency of the alternate conduction period of the transistors.

Figure 14:
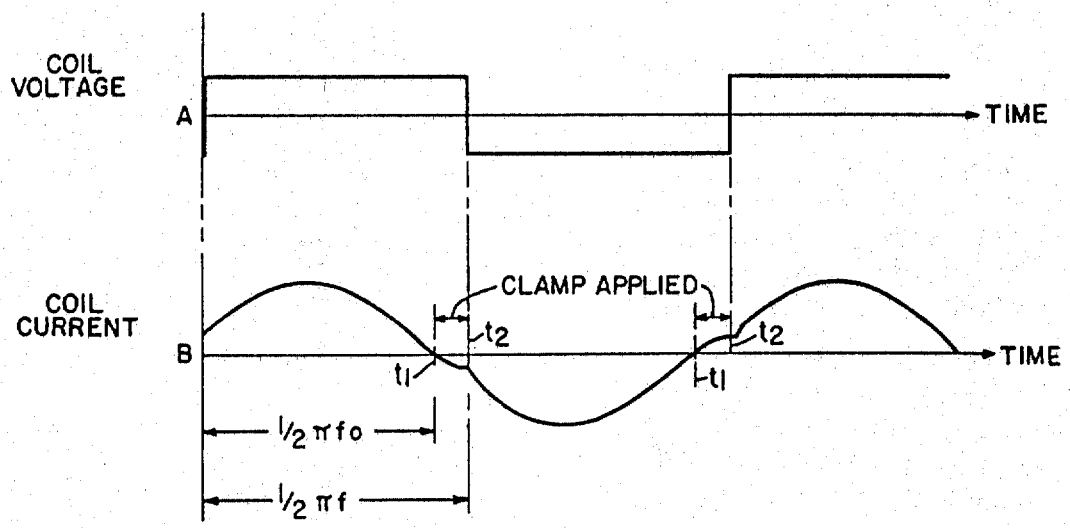
FIG. 14 illustrates how clamping of the power switches changes the frequency of the power output in the apparatus according to the present invention.

FIG. 14 shows two curves A and B illustrating clamping action. Curve A represents the coil voltage as applied between terminals A and B. Curve B represents the coil current as affected by clamping during the time interval $t_1$–$t_2$, which is initiated at a time $t_1$ corresponding to zero-crossing of the current.

If winding $T_{1d}$ is effectively clamped, e.g. short circuited, by means of a diode bridge formed of diodes $D_4$ and transistor $Q_3$, (FIG. 9) no base-emitter voltage can be developed by either of the drive windings $T_{1a}$, $T_{1b}$. Both transistors are therefore forced into their non-conducting state. By clamping the transformer for a variable time delay after each zero-crossing of the load current, it is possible to obtain any desired reduction in the oscillator frequency.

When the clamp is applied at a "zero crossing" the load current flows through one of the diodes $D_4$ and winding $T_{1d}$. This prevents reciprocal conduction between outgoing and oncoming transistors. The voltage applied to the resonant circuit does not change as it normally would. Only when the clamp is released does the voltage switch polarity.

Figure 15:
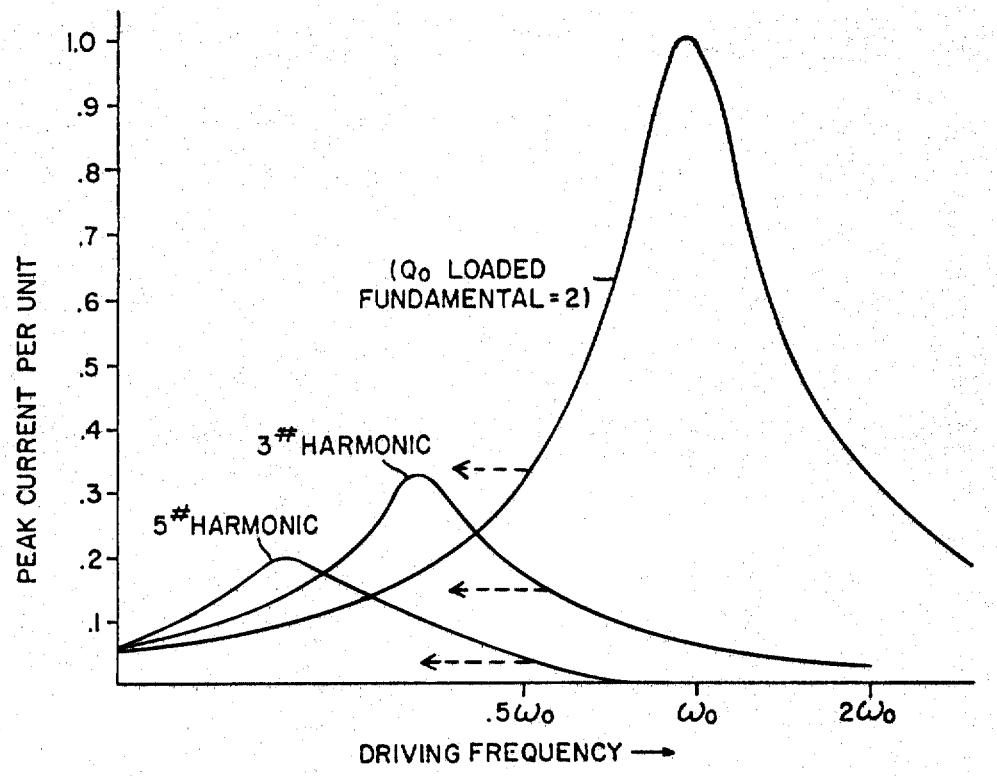
FIG. 15 shows a peak current obtained as a function of the driving frequency for the loaded condition at $Q_o = 2$, e.g. under low Q requirement.
Figure 16:
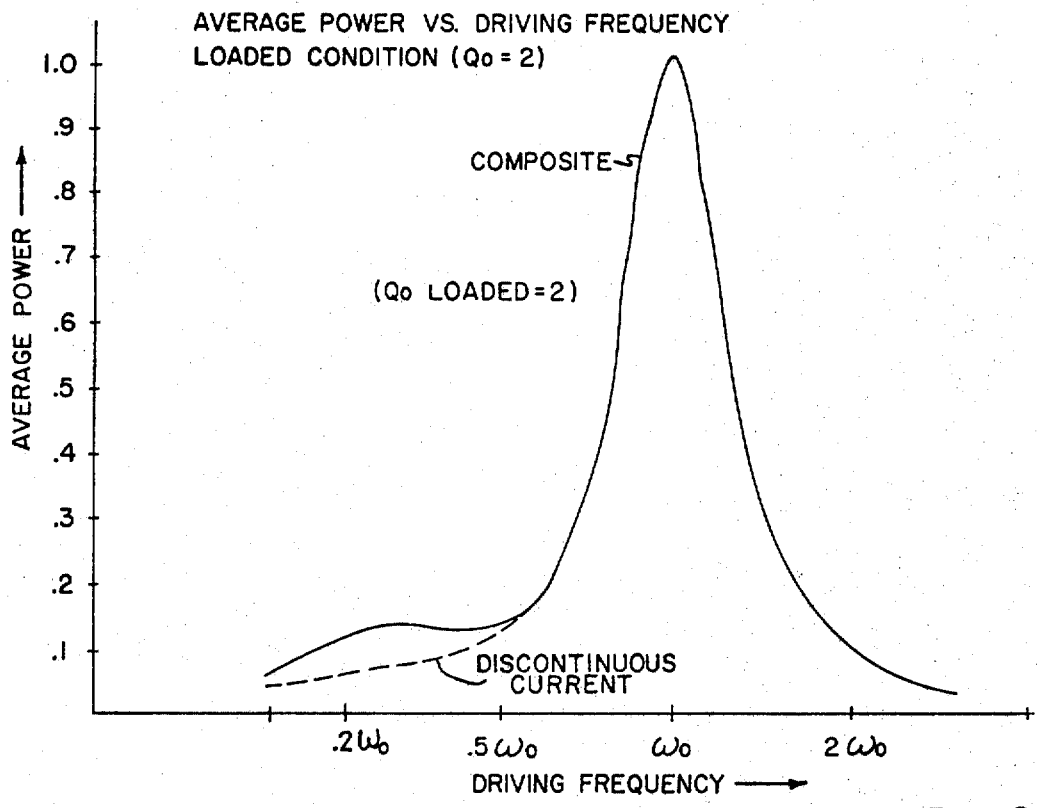
FIG. 16 shows average power obtained as a function of the driving frequency under the same conditions as for FIG. 15.

It can be shown that when the variable time delay is increased beyond the point when the frequency is one-half of the resonant frequency, the load current becomes discontinous, and the current and power depart from the theoretical curves of FIGS. 4 and 7. The peak current remains constant and the power decays linearly as shown by the dotted lines in FIGS. 15 and 16. For this reason, there is a decreased benefit in lowering the frequency below $\frac{1}{2}\omega_o$.

Power reduction down to 5% of maximum power is required for cooking. In this respect, an examination of the curve shown in FIG. 16 reveals that it would then be necessary to operate at a minimum frequency $\omega_{min}$ equal to a $0.2\omega_o$. Since $\omega_{min}$ must be greater than 20 khz, $\omega_o$ would have to be greater than 100 kHz. This is clearly beyond the capability of the low cost power transistors now available. This solution being excluded an alternative is to raise the loaded Q of the circuit ($Q_o$ (LOADED)), by spacing the pan further away from the coil. A two to one increase in Q would be sufficient as it appears from FIG. 8. However, this would double the coil and capacitor voltages and increase the cost. A better solution has been adopted for the apparatus, according to the invention consisting in allowing a lowering of the frequency only down to $\frac{1}{2}\omega_o$ and obtaining the remaining lower range obtained by time modulation of the oscillator for instance at a rate of about 1 or 2 Hz. The oscillator's fundamental resonant frequency was selected to be about 44 kHz, the minimum frequency achieved being of 22 kHz. In order to emphasize the distinction between using a feedback control signal for voltage control as described in aforementioned U.S. Pat. No. 3,806,688 and deriving a feedback control signal for frequency control according to the present invention theoretical considerations are necessary regarding voltage control as in the prior art.

Considering equation (19), an expression of the control signal $V_c$ may be derived as follows:

$$V_c = V_{cap\,pk} - E = \frac{4}{\pi}\left(Q_o - \frac{\pi}{4}\right) \tag{20}$$

Where $V_{cap}$ is the voltage across a resonant power capacitor, e.g. $C_1$ or $C_2$ of FIG. 9. Deriving an expression of the resonant energy from the resonant capacitor is equivalent to deriving the control signal from the resonant work coil. This control voltage $V_c$ is compared to a reference $V_R$, and the resulting error signal appropriately fires a solid state device in order to control the dc input voltage. The feedback loop only leaves a small error signal, so that the reference $V_R$ and the control voltage are nearly equal. If voltage $V_c$ as expressed by equation (20) is adjusted so that it corresponds to the voltage E of the D.C. source, and for $Q_o = Q_o$ (LOADED) then, $$\frac{V_c}{V_{cmax}} = \frac{E\left(Q_o - \frac{\pi}{4}\right)}{E_{max}\left(Q_o(\text{LOADED}) - \frac{\pi}{4}\right)} \tag{21}$$

It is clear that when the pan is in position (e.g. $Q_o$ is constant), the voltage E is directly proportional to the control voltage. The coil current then is also proportional to $V_c$ and the power varies with the square of $V_c$.

In order to determine how the current behaves when the pan is removed, an expression for the fundamental peak current $I_{ml}$ in terms of the maximum value $I_{ml\,max}$ occurring under the voltage E with the pan in position can be derived from equation (15) as follows:

$$\frac{I_{ml}}{I_{ml\,(max)}} = \frac{E\,Q_o}{E_{max}\,Q_o(\text{LOADED})} \tag{22}$$

Substituting into Equation (21) the new expression is as follows:

$$\frac{I_{ml}}{I_{ml\,(max)}} = \frac{V_c(Q_o(\text{LOADED}) - \frac{\pi}{4})\,Q_o}{V_{c\,(max)}(Q_o - \frac{\pi}{4})\,Q_o(\text{LOADED})} \tag{23}$$

Figure 17:
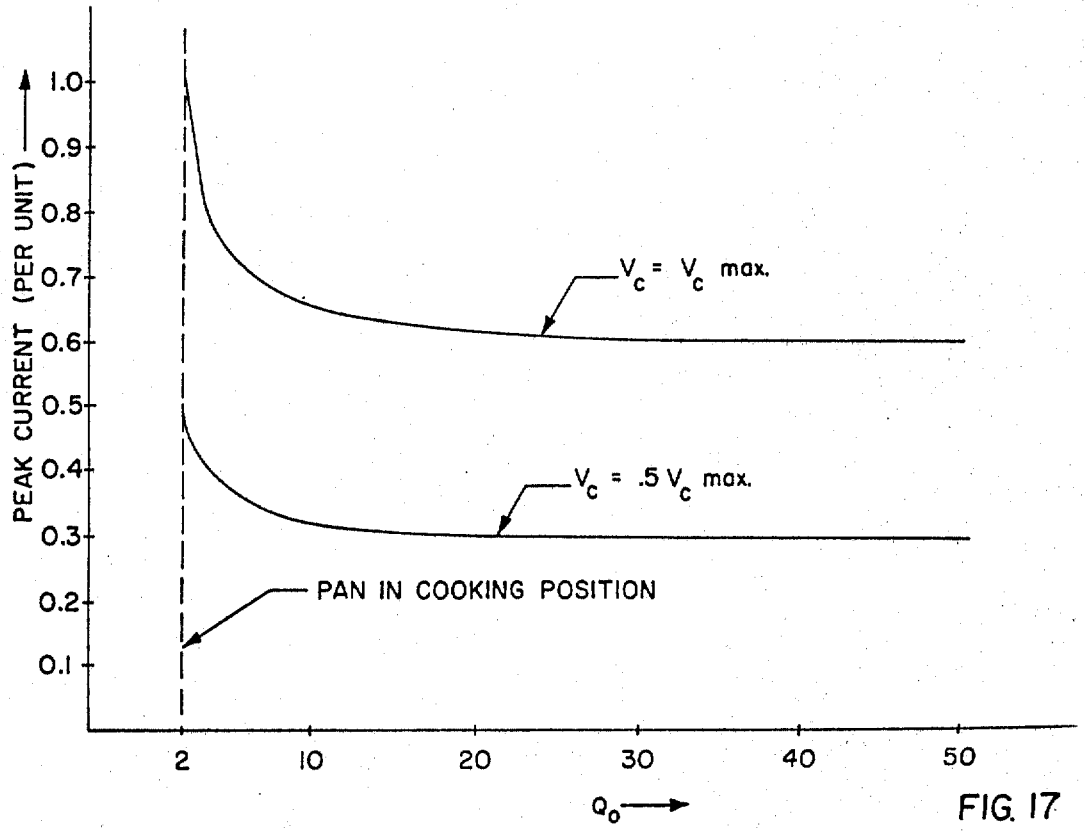
FIG. 17 are curves representing peak current as a function of $Q_o$ for different values of the direct current voltage supply.

FIG. 17 shows a plot of the normalized current as a function of $Q_o$ in the case where $Q_o$(LOADED) = 2. As can be seen, when the pan is removed, the current goes to about 60% of its value with the pan on. This is a desirable feature because it cuts down on losses and stray fields when no cooking pan is in place.

Considering now the feedback loop provided in accordance with the present invention which is used to control the frequency as desirable for cooking, the control variable $V_c$ is compared to a reference $V_R$, and the feedback loop ensures that $V_c$ and $V_R$ are nearly equal.

The control voltage $V_c$ is a complex function. $V_c$ is a function of both $Q_o$ and $\omega$ and may be expressed by the following relationship:

$$\frac{V_c}{E} = \frac{4}{\pi}\frac{\cos(\omega t_1)}{\sqrt{\left(1-\frac{\omega^2}{\omega_o^2}\right)^2 + \frac{\omega^2}{\omega_o^2 Q_o^2}}} - \frac{1}{2} + \frac{1}{\pi}\cos(\omega t_1) \tag{24}$$

where $$\omega t_1 = \sin^{-1}\left(\frac{\pi}{4}\sqrt{\left(1-\frac{\omega^2}{\omega_o^2}\right)^2 + \frac{\omega^2}{\omega_o^2 Q_o^2}}\right) \tag{25}$$

Figure 18:
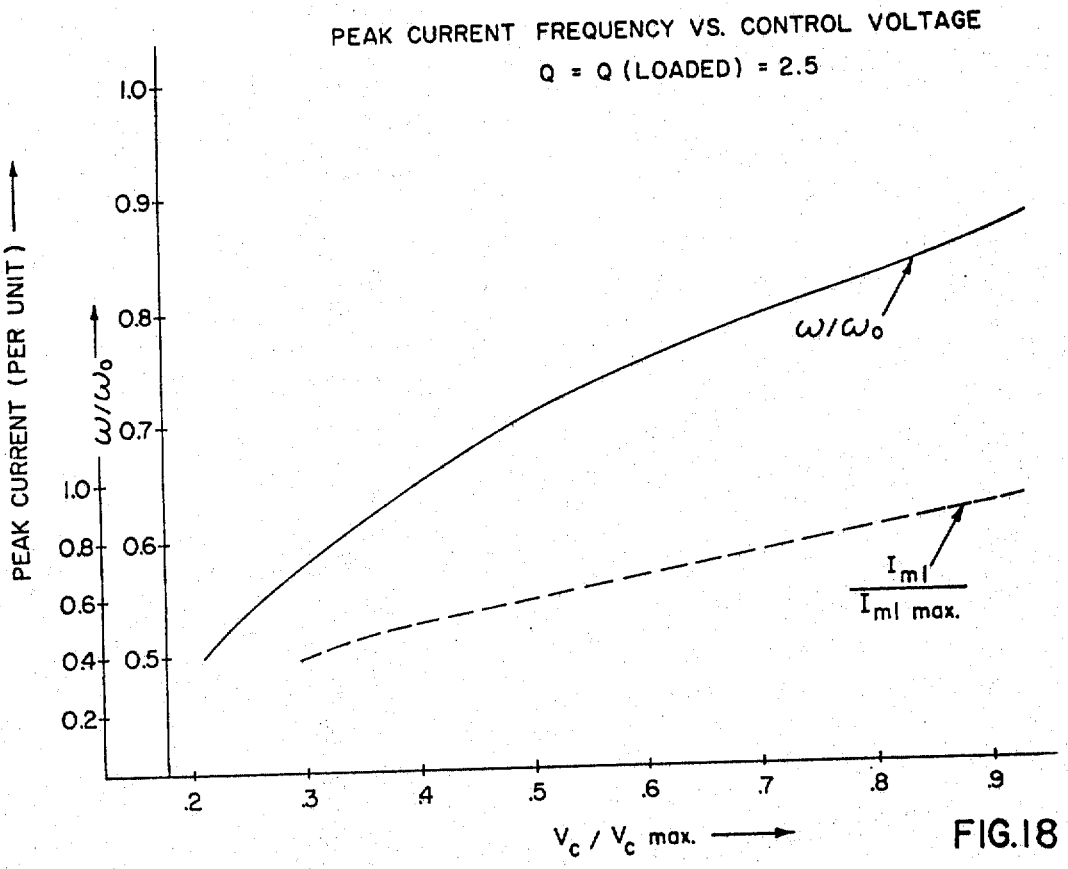
FIG. 18 shows together the peak current and the frequency as a function of the direct current voltage.

The first thing in determining how the frequency and current vary with the control voltage for normal conditions with the pan in position, is to assume that $V_{c\,max}$ is the control voltage at resonance for a constant Q equal to $Q_o$(LOADED). Then the frequency $\omega$ may be plotted as a function of $V_c$ as shown in FIG. 18. The peak current (fundamental component) is also plotted against $V_c$ by substitution into Equation (8). For $Q_o$(LOADED) = 2.5, the current decreases almost linearly with $V_c$, and the power decreases approximately with the square of $V_c$.

Figure 19:
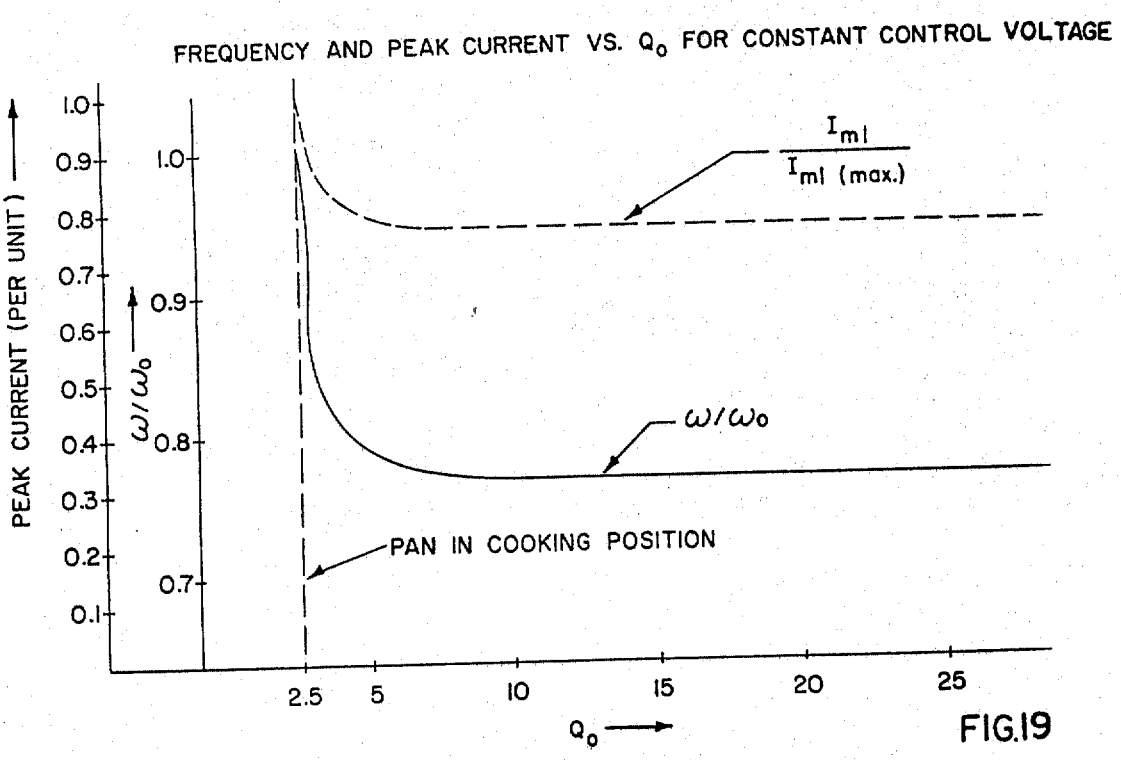
FIG. 19 shows together the frequency and peak current as a function of $Q_o$ for a given direct current voltage.

In determining the effect of pan removal when the control voltage is held constant, reference is made to FIG. 19 in which frequency is plotted against $Q_o$ for $V_c$ held constant at $V_{c\,max}$. For $Q_o$(LOADED) = 2.5, it is seen that $\omega$ decreases to about 77% of $\omega_o$ when the load is removed.

Since $V_c$ is held constant, it is clear that the capacitor voltage $V_{cap}$ is also constant and the following expression can be written:

$$\frac{I_{ml}}{I_{ml\,max}} = \frac{V_{cap}\omega C}{V_{cap}\omega_o C} = \frac{\omega}{\omega_o} \tag{26}$$

When the pan is removed, the current decreases proportionally to the decrease in frequency. Also according to FIG. 19, a 77% reduction in peak current occurs. The desired reduction in current is sufficient to ease transistor stresses and reduce stray fields. As earlier mentioned and as described specifically hereinafter, a secondary signal may be injected into the feedback loop in order to achieve further current reduction.

DESCRIPTION OF THE PREFERRED EMBODIMENT

Figure 20:
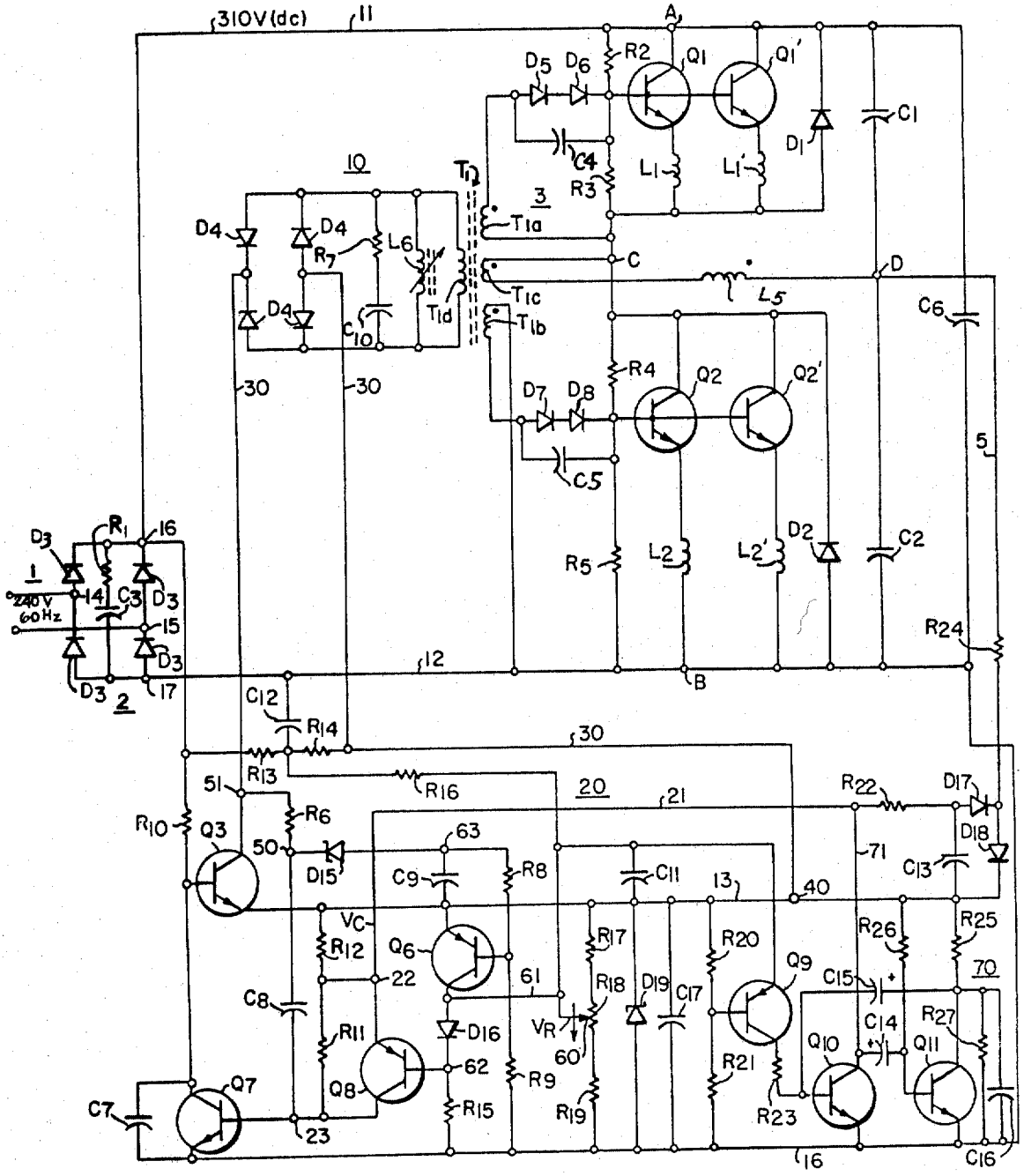
FIG. 20 shows the circuitry of the apparatus according to the present invention in the preferred embodiment.

Referring to FIG. 20, power is supplied from a 60 Hertz, 240 volts alternating current source 1 to input terminals 14, 15 of a full wave rectifier bridge 2 including rectifiers $D_3$ mounted between input terminals 14, 15 and two output terminals 16, 17 carrying direct current voltage on lines 11, 12 to the terminals A, B of opposite polarities of an inverter 3. The rectifier bridge 2 also includes a filter capacitor $C_3$ and a resistor R used as a surge limiter between output terminals 16, 17.

A series resonant circuit comprising the work coil $L_5$ and capacitors $C_1$ $C_2$ is mounted as a half-bridge split capacitor arrangement such as shown in FIGS. 3 and 9, between a power oscillator and the D.C. lines 11, 12. The power oscillator is similar to the one shown in FIG. 9. In FIG. 20 two pairs of transistor switches $Q_1$, $Q'_1$ and $Q_2$, $Q'_2$ are alternately controlled for conduction between terminals A, B and a common junction, point C, inverse parallel diodes $D_1$, $D_2$ being mounted across each bank of transistors in order to allow reactive load current when both groups of transistors during control in accordance with the present invention are switched off at the same time. A by-pass capacitor $C_6$ is mounted across terminals A, B in order to attenuate r.f. voltages on the supply lines 11, 12. The work coil $L_5$ which is used for cooking when inductively coupled with a pan, is mounted between junction point D common to capacitors $C_1$, $C_2$ and junction point C common to the two groups of transistors. A dot near work coil $L_5$ indicates on FIG. 20 the starting end of the winding. When connected as shown, capacitive coupling to the pan is minimized. In the emitter leads of the power switches, inductors are provided, namely $L_1$ (for $Q_1$), $L'_1$ (for $Q'_1$), $L_2$ (for $Q_2$) and $L'_2$ (for $Q'_2$) which are used to improve matching of the switching speeds and reduce the cost. These inductors have an inductance of for instance 0.33$\mu$H, which can easily be formed on a printed circuit board. These inductors also cause steeper voltage transitions to occur on the base winding-hereinafter described-thereby to improve triggering of the time delay circuit-also to be described hereinafter.

Inverter 3 includes a feedback transformer $T_1$ having a primary winding $T_{1c}$ and two secondary windings of opposite polarities $T_{1a}$, $T_{1b}$. Winding $T_{1c}$ is energized alternately by the resonant circuit formed by $L_5$ and $C_1$, $C_2$. Windings $T_{1a}$, $T_{1b}$ are connected to the respective base electrodes of the two groups of transistors via diodes $D_5$ $D_6$ and $D_7$ $D_8$ which are paralleled by capacitors $C_4$ and $C_5$ respectively. The power switches are alternately driven to conduction in synchronization with the resonant condition of the work coil $L_5$ and capacitors $C_1$, $C_2$. Starting bias is supplied by resistors $R_2$, $R_3$, $R_4$ and $R_5$. Windings $T_{1a}$ and $T_{1b}$ are marked with dots to indicate the polarities proper for alternate conduction.

The power circuit 3 is designed for maximum power output when the work coil $L_5$ and capacitors $C_1$, $C_2$ operate at natural resonance, and the natural resonant frequency is selected for the maximum ultrasonic frequency desired. As earlier mentioned, it is the purpose of the apparatus according to the present invention to control the power output by off-setting the heating coil from natural resonance, preferably below and this is achieved by introducing a variable time delay $t_1$–$t_2$ as explained hereabove by reference to FIG. 9. However, when the variable time delay is increased beyond the point where the frequency is one-half of the natural resonant frequency, the load current becomes discontinuous, and the current and power depart from the theoretical curves of FIGS. 4 and 7. Instead, the peak current remains constant and the power decays linearly as shown by the dotted lines of FIGS. 15 and 16. Therefore lowering frequency below $\frac{1}{2}\omega_o$ is not practical. Still it is necessary for cooking to be able to reduce power down to 5% of the maximum power of 1600 watts, thus down to 80 watts, which would require a minimum frequency $\omega_{min} = 0.2\omega_o$. Such minimum frequency should be greater than 20 kHz, otherwise it would be audible, thus unpleasant to the ear of the user. From a minimum frequency of $0.2\omega_o = 20$ kHz the maximum frequency would reach $\omega_o = 100$ kHz, which would be too fast for low cost power transistors. Therefore the choice has been made, in the preferred embodiment, of a natural frequency of 44 kHz which entails a minimum frequency of 22 kHz (down to $\frac{1}{2}\omega_o$) as the practical limit of frequency control. An additional feature is provided in the form of a booster control unit 70 on FIG. 20. The main control unit is shown at 20 in FIG. 20. The maximum power is determined by cooking conditions in practice. It is generally recognized that 1000 watts is the maximum power necessary. The main control unit 20 is provided around voltage lines 12, 13 and 16. Line 16 is an extension of line 12 to which are connected the emitter leads of transistors $Q_7$, $Q_{10}$ and $Q_{11}$, as will be explained hereinafter. The voltage on line 13 is established by a Zener diode $D_{19}$ connecting lines 16 and 13 from the anode to the cathode electrode. Line 13 will be hereinafter called the reference voltage line. The controlled variable in U.S. Pat. No. 3,806,688 was the excursions of the work coil voltage beyond the D.C. voltage applied at terminals A or B and driving the work coil, and capacitor. In the apparatus according to the invention also the control loop derives a signal representing such excursions. Instead of using a current transducer and diode associated with the work coil as in the patent just-mentioned, the apparatus according to the present invention, the controlled variable is derived from the capacitor side. Thus at D on line 5, via resistor $R_{24}$ and reverse diode $D_{17}$, the controlled variable is derived on each negative excursion which makes reverse diode $D_{17}$ conducting. As a result, capacitor $C_{13}$ which is connected to line 13 at the other end thereof is charging. This operation results in averaging out the successive voltage excursions thus referring to FIGS. 13 or 14, capacitor $C_{13}$ being charged in accordance with the areas of such excursions rather than the peak amplitude. However, it can be shown that, provided $Q_o > 2$, the peak value is nearly proportional to the average value, in practice.

The charged capacitor $C_{13}$ is connected on the diode side to a resistor $R_{22}$ and via line 21 to a parallel network comprising resistor $R_{11}$ and transistor $Q_8$, which establishes a discharge path for capacitor $C_{13}$ to one end 23 of a capacitor $C_8$. Actually, there is a main path including a reference resistor $R_{12}$ from line 13 to resistor $R_{11}$ and transistor $Q_8$. The main path carries a total current from which the discharge current from capacitor $C_{13}$ is in fact subtracted. Thus, the magnitude of the controlled variable detected by diode $D_{17}$ is indirectly affecting the potential build-up at point 23, when capacitor $C_8$ is being charged. In order to explain the charging and discharging of capacitor $C_8$, the clamping circuit 10 should be described with its interaction with the main control unit 20. The clamping circuit 10 is similar to the clamping circuit of FIG. 9. Thus, FIG. 20 shows a clamping transistor $Q_3$ which is part of a loop extending via lines 30 from the input terminals of a full wave rectifier bridge comprised of diodes $D_4$, to point 40 on line 13 and to point 51 at the collector end of transistor $Q_3$. The output terminals of the rectifier bridge are connected to a clamp winding $T_{1d}$ paralled by a variable phase shift inductor $L_6$ of transformer $T_1$. The variable inductor $L_6$ is adjusted for optimum phase advance at maximum power resulting in excess advance at minimum power due to the combined effects of the reactance of the inductor changing with frequency and the speed of the devices changing with current level. Also connected across the output of the rectifier bridge is a network, comprising a resistor $R_7$ in series with a capacitor $C_{10}$, which surpresses high frequency ringing. A clamping action on such winding $T_{1d}$ occurs each time the base of transistor $Q_3$ causes conduction thereof, and for a time interval, $t_1$–$t_2$ as shown in FIG. 14, defined by the OFF condition of transistor $Q_7$. Transistors $Q_7$ and $Q_3$ are connected so as to form a monostable multivibrator having a period determined by the time constant of capacitor $C_8$ and the parallel combination of $R_{11}$ and $Q_8$. This time constant is modified by the current conditions in resistors $R_{12}$, $R_{11}$ and the by-pass through transistor $Q_8$. The monostable pulse width is determined by $C_8$ and $R_{11}$ in parallel with the variable current source $Q_8$. The collector of $Q_7$ is connected to the base of $Q_3$. A capacitor $C_7$ is used to delay the turn-on of $Q_3$ in order to compensate for the effect of reactances $L_1$, $l'_1$, $L_2$, $L'_2$ on switching of the power switches, e.g. the phase shift affecting the timing of the zero-detection from winding $T_{1d}$. The base current of $Q_3$ is supplied via resistor $R_{10}$ from an unregulated supply so as to maintain a constant base current collector current ratio, since the collector current is a function of the supply voltage. The stable mode of the monostable multivibrator is when the clamp transistor $Q_3$ is OFF. The negative-going voltage at point 51 initiates the unstable mode, and the duration of the unstable mode ($t_1$–$t_2$) depends on the current level in $Q_8$. Thus the oscillator 3 is inhibited for a variable time period ($t_1$–$t_2$) at the start of each half cycle. When transistor $Q_3$ is conducting winding $T_{1d}$ is short-circuited and the transistor banks $Q_1$, $Q'_1$ and $Q_2$, $Q'_2$ are prevented from being brought to conduction by winding $T_{1a}$ or $T_{1b}$. Referring to FIG. 14, instant $t_1$ represents zero-crossing of the transistor current. When the two banks are alternately conducting, winding $T_{1d}$ reflects this situation on lines 30 from the bridge rectifier (Diodes $D_4$). Upon each zero-crossing (e.g. at time $t_1$) the voltage at point 51 is quickly brought back negatively. Zener diode $D_{15}$ is reversely connected to point 50, via resistor $R_6$ to point 51. The anode side of the Zener diode $D_{15}$ is connected to a capacitor $C_9$ connected to line 13 by the other end. This capacitor averages out the pulses, at point 51 which correspond to successive alternate conduction periods of the transistor banks $Q_1$, $Q'_1$ and $Q_2$, $Q'_2$. From point 51 via resistor $R_6$, point 50 and capacitor $C_8$, the voltage of the base of transistor $Q_7$ at point 23 is established at the conduction level each time the voltage at point 51 is brought back negatively, e.g. at time $t_1$. It is recalled that capacitor $C_8$ is being charged $R_{11}$ and $Q_8$ during discharging of capacitor $C_{13}$ to an amount which is related to the voltage excursions at point D as detected by reverse diode $D_{17}$. Such charging operation takes place while $Q_7$ is cut-off, e.g.

while $Q_3$ is ON. The charging operation is progressively raising the base level of tranisistor $Q_7$ until such time $t_2$ when $Q_7$ turns ON, which causes $Q_3$ to turn OFF. In this fashion the time delay $t_1$–$t_2$ is defined in part by the charge accumulation on capacitor $C_{13}$ which causes a shorter, or longer, duration in charging of capacitor $C_8$. Such charging operation also depends on the fraction of current passing through transistor $Q_8$ as opposed to resistor $R_{11}$. Control of the base of transistor $Q_8$ at point 62 modifies such contribution and permits adjusting the time delay $t_1$–$t_2$. Such adjustment is made from potentiometer $R_{18}$, having a tap at 60, which is part of a voltage divider $R_{17}$, $R_{18}$, $R_{19}$ connected between lines 13 and 16. From tap 60 the adjusted voltage is carried along 61, diode $D_{16}$ — which is a temperature compensating diode — then to base 62, which is itself connected via resistor $R_{15}$ to line 16. The user is then able by changing tap 60 to lengthen, or shorten, the time interval $t_1$–$t_2$ and therefore to control the frequency level, e.g. the setting of the power output. The control button may be set for several positions corresponding to maximum power, intermediary power levels, and low power, which are like the high, medium and low settings of a conventional cooking range. Having selected a particular setting, any change in the controlled variable, as could be caused by outside events such as a change in the A.C. input voltage of source 1, or the Q of the load (for resistance when the position of the pan is modified, or even if the pan is removed) will be automatically compensated by the loop from point D via line 5, diode $D_{17}$, capacitor $C_{13}$, resistor $R_{22}$, resistor $R_{11}$, transistor $Q_8$ and capacitor $C_8$, as hereabove explained. Diode $D_{18}$ is provided from the cathode of reverse diode $D_{17}$ to the reference line 13 in order to prevent excessive reverse voltage from being applied to diode $D_{17}$ between successive conducting operations thereof.

The apparatus according to the present invention also includes an important safety feature which is to be found in the circuit combination of Zener diode $D_{15}$, capacitor $C_9$, resistors $R_8$, $R_9$ and transistor $Q_6$. When the power oscillator is not oscillating, no compensating action is possible by the control loop from line 5 to the clamping circuit 10. However, should there be at that moment too much power applied to the system, for instance because of a high setting on tap 60, or if the pan has been removed, the stresses so occasioned could wreck the installation. In order to prevent this, transistor $Q_6$ is set in the conductive state whenever the power oscillator is not normally operative. When $Q_6$ is conducting the voltage at point 62 is such that transistor $Q_8$ is turned OFF. When transistor $Q_8$ is turned OFF no current is by-passing resistor $R_{11}$ and the time constant of the monostable multivibrator formed by $Q_3$, $Q_7$ is the longest, e.g. the frequency is at the minimum. Therefore power is low. In order to set transistor $Q_6$ in the OFF state for normal operation, Zener diode $D_{15}$ establishes at point 63 on capacitor $C_9$ a unilateral voltage which represents a clipped series of pulses from the clamping winding $T_{1d}$ when the power switches $Q_1$, $Q'_1$, $Q_2$, $Q'_2$ are alternately conducting. Capacitor $C_9$ integrates the voltage at point 63, and the potential there established causes a cut-off potential to appear on the base of transistor $Q_6$. In the absence of conduction of the power switches $Q_1$, $Q'_1$ and $Q_2$, $Q'_2$, capacitor $C_9$ will not charge and $Q_6$ is ON. Therefore, should there be a blackout, when the line voltage returns, and more generally when starting the cooking range, the system will be automatically operating at a low power level.

Consideration will now be given to the booster control unit 70 which is essentially an astable multivibrator including transistors $Q_{10}$, $Q_{11}$, operation of which is initiated by transistor $Q_9$ having its base connected to the junction of a voltage divider formed by resistors $R_{20}$ and $R_{21}$ which are serially connected between lines 13 and 16. Assuming the wiper 60 of potentiometer $R_{18}$ is brought by the user from the low power setting to a mininum power setting further down on the potentiometer, the average potential of a capacitor $C_{11}$ and the voltage between emitter and base on transistor $Q_9$ will become such that transistor $Q_9$ becomes conducting, and therefore via resistor $R_{23}$ transistor $Q_{10}$ is turned ON. Capacitors $C_{14}$, $C_{15}$ and resistors $R_{26}$, $R_{23}$ determine the two periods of the astable multivibrator. When $Q_{10}$ is conducting the emitter of transistor $Q_8$ is brought via lines 21 and 71 to the ground potential of line 16. Therefore $Q_8$ is OFF and transistor $Q_7$ blocked in the OFF state. As a result $Q_3$ is ON all the time, clamping the power oscillator 3. When $Q_{11}$ conducts, the circuit returns to normal operation. The frequency periods of the astable multivibrator are so selected that a time modulation of 1 or 2 Hz occurs. The power oscillator 3 is cut-off half of the time. As explained hereabove, the low power setting of wiper 60 on resistor $R_{18}$ which is the lowest setting obtained by frequency control on the base of transistor $Q_8$. Then the cut-off time of transistor $Q_7$ corresponds (at 22 kHz) to 10% only of the maximum power available at 44 kHz. Operation of the booster control unit 70 reduces further the power by such power available at the low power setting. Thus, the range of control is brought down to 5% of maximum power as required by cooking practice.

Current for the low level control stages is supplied by resistors $R_{13}$ and $R_{14}$, via a resistor $R_{16}$ and the supply is voltage regulated by the Zener diode $D_{19}$. A capacitor $C_{12}$ at the junction of $R_{13}$ and $R_{14}$ provides additional ripple reduction. To summarize the operation of the apparatus according to the present invention, it is assumed that, as in any type of cooking range, a button is provided on the panel which may be set to OFF, MINIMUM, LOW or HIGH positions. When the button is in any position but the OFF postion, the apparatus is started, e.g. the wiper of resistor $R_{18}$ controls. Since the power switches are not working initially when the apparatus is started, transistor $Q_6$ is ON and transistor $Q_8$ is OFF, that is as explained hereabove, even if the wiper has been set for the HIGH setting, or if no pan has been placed on the work coil W, power demanded from the apparatus will be initially low. When the power switches have started reciprocal action, $Q_9$ is turned OFF, and $Q_8$ is turned ON for normal control operation.

Depending on the power setting adopted by the user, the base current on transistor $Q_8$ will determine the time span of the time interval ($t_1$–$t_2$) that clamp transistor $Q_3$ is turned ON. The longer $t_1$–$t_2$ the lower the frequency. It is recalled that the apparatus is so arranged that maximum power (1600 watts) is obtained at natural resonance ($t_1$–$t_2$=0) for 44 kHz. The lower settings of tap 60 will provide predetermined time intervals ($t_1$–$t_2$) with the LOW setting on resistor $R_{18}$ corresponding to a frequency of 22 kHz thus close to the audible range, which corresponds to about 10% of maximum power (80 watts), for instance. When the control button is set at MINIMUM, at the bottom of resistor $R_{18}$, transistor $Q_9$ becomes conducting and the astable multivibrator 70 is triggered. As a result transistor $Q_3$ is now blocked in the conduction state half of the time. Therefore initially half of the power available when the astable multivibrator does not work is now being cut-off. This brings the power output from 10% to 5%, in the specific embodiment described.

It appears that the network formed by resistors $R_{12}$, $R_{11}$ and transistor $Q_8$ cooperate with capacitor $C_8$ in establishing the time constant of the monostable multivibrator $Q_7$–$Q_3$, and that such network is responsive to both the limiting and regulatory control signals required for proper operation. This means that a single loop, comprising line 5, reverse diode 17 resistor $R_{22}$ and line 21 and the aforementioned network takes care of brutal changes in the Q of the coil (for instance on pan removal) as well as small variations of a regulatory nature (for instance if the power supply voltage changes). This is due to the fact that the control signal is a function of $Q_o$ of the coil and of the D.C. voltage driving the cook coil. In addition, the aforementioned network is of a differential nature, responding to both the controlled variable signal applied at point 23 and the manual setting control signal applied to the base of transistor $Q_8$ from the wiper 60. These are novel and unique features generally to the system compactness, simplicity, ruggedness, and low cost.

The apparatus, according to the present invention, provides excellent performance at low cost. A significant reduction of the hardware and a compact arrangement result from the particular design of the circuitry especially the choice of frequency control rather than voltage control. The elimination of a filter choke is also attractive. Frequency control has been adapted to the practical necessity of cooking operation without losing the advantage derived from the selection as the controlled variable of a function of Q and the D.C. voltage supply, and a resonant power output circuit is used as generally accepted today for a cool top range operating at ultrasonic frequency for cooking.

The following Table II sets forth an illustrative embodiment of the present invention that has been constructed.

TABLE II

| Components | | Characteristics or Type |
|---|---|---|
| $C_1$ | .068 μF | 800 V |
| $C_2$ | .068μF | 800 V |
| $C_3$ | 580μF | 400 V |
| $C_4$ | 10μF | 50 V |
| $C_5$ | 10μF | 50 V |
| $C_6$ | .68 | 400 V |
| $C_7$ | 300 pF | Cer. |
| $C_8$ | 220 pF | SM |
| $C_9$ | .033μF | 50 V |
| $C_{10}$ | 500 pF | Cer. |
| $C_{11}$ | .1μF | 50 V |
| $C_{12}$ | 1μF | 200 V |
| $C_{13}$ | 1μF | 50 V |
| $C_{14}$ | 5μF | 10 V |
| $C_{15}$ | 5μF | 10 V |
| $C_{16}$ | .1μF | 50 V |
| $C_{17}$ | 1μF | 50 V |
| $D_1$ | MR824 | |
| $D_2$ | MR824 | |
| $D_3$ | MR754 | |
| $D_4$ | In645 | |
| $D_5$ | IN5400 | |
| $D_6$ | IN5400 | |
| $D_7$ | IN5400 | |
| $D_8$ | IN5400 | |
| $D_{15}$ | IN751 | |
| $D_{16}$ | IN4148 | |
| $D_{17}$ | IN4148 | |
| $D_{18}$ | IN4148 | |
| $D_{19}$ | IN751 | |
| $L_1$ | .33μH (3 T #20 ⅛" dia.) | |
| $L_1'$ | .33μH (3 T #20 ⅛" dia.) | |

TABLE II-continued

| Components | | Characteristics or Type |
|---|---|---|
| $L_2$ | .33μH (3 T #20 ⅛" dia.) | |
| $L_2'$ | .33μH (3 T #20 ⅛" dia.) | |
| $L_5$ | 38 T #16 Litz | |
| $L_6$ | 1.25 - 2.6 mH | |
| $Q_1$ | 2N6306 | |
| $Q_1'$ | 2N6306 | |
| $Q_2$ | 2N6306 | |
| $Q_2'$ | 2N6306 | |
| $Q_3$ | 2N2405 | |
| $Q_6$ | 2N2907 | |
| $Q_7$ | 2N2222 | |
| $Q_8$ | 2N2907 | |
| $Q_9$ | 2N2907 | |
| $Q_{10}$ | 2N3391 | |
| $Q_{11}$ | 2N3391 | |
| $R_1$ | .06 Ω | 50 W |
| $R_2$ | 27 K | 2 W |
| $R_3$ | 150 Ω | ¼ W |
| $R_4$ | 27 K | 2 W |
| $R_5$ | 150 Ω | ¼ W |
| $R_6$ | 5.6 K | ¼ W |
| $R_7$ | 560 Ω | ¼ W |
| $R_8$ | 27 K | ¼ W |
| $R_9$ | 12 K | ¼ W |
| $R_{10}$ | 82 K | 2 W |
| $R_{11}$ | 47 K | ¼ W |
| $R_{12}$ | 2.7 K | ¼ W |
| $R_{13}$ | 27 K | 2 W |
| $R_{14}$ | 27 K | 2 W |
| $R_{15}$ | 82 K | ¼ W |
| $R_{16}$ | 820 K | ¼ W |
| $R_{17}$ | 5.6 K | ¼ W |
| $R_{18}$ | 10 K | Lin. Taper |
| $R_{19}$ | 6.8 K | ¼ W |
| $R_{20}$ | 27 K | ¼ W |
| $R_{21}$ | 82 K | ¼ W |
| $R_{22}$ | 10 K | ¼ W |
| $R_{23}$ | 680 K | ¼ W |
| $R_{24}$ | 100 K | 1 W |
| $R_{25}$ | 2.7 K | ¼ W |
| $R_{26}$ | 820 K | ¼ W |
| $R_{27}$ | 10 K | ¼ W |
| $T_1$ | Pri. 1T, Sec. 2 × 5 T; 66T | |

We claim:

1. In an apparatus for heating a cooking utensil by magnetic induction and operative with a direct current power supply, the combination of:

induction coil means adapted to be inductively coupled to a cooking utensil;

series resonant circuit means having a natural frequency of resonance in the ultrasonic range and including said induction coil means;

switching means connected to said direct current power supply for converting direct current power into alternating current power at ultrasonic frequency and for energizing said series resonant circuit means;

means operative with said series resonant circuit means and said direct current power supply for providing a first signal indicative of voltage excursions of said series resonant circuit means beyond the voltage level of said direct current power supply;

means for integrating said voltage excursions to provide an average value of said first signal;

means for varying the frequency of operation of said switching means from at least approximately one-half of said natural frequency of resonance to said natural frequency of resonance in response to said first signal to control the power output of said apparatus when said induction coil means is inductively coupled to a cooking utensil; and control means for providing a manual control signal, said frequency varying means being responsive to both said first signal and said manual control signal, said frequency varying means including means for clamping said switching means, time delay means for establishing a clamp time interval, with said time delay means being responsive to both said first signal and said manual control signal for establishing a time constant in relation to said first and manual control signals, said frequency varying means further including means responsive to said time delay means and operative with said clamping means for changing the frequency of operation of said switching means in relation to said clamp time interval.

2. In an apparatus for heating a cooking utensil by magnetic induction and operative with a direct current power supply, the combination of:

induction coil means adapted to be inductively coupled to a cooking utensil;

series resonant circuit means having a natural frequency of resonance in the ultrasonic range and including said induction coil means;

switching means connected to said direct current power supply for converting direct current power into alternating current power at ultrasonic frequency and for energizing said series resonant circuit means;

means operative with said series resonant circuit means and said direct current power supply for providing a first signal indicative of voltage excursions of said series resonant circuit means beyond the voltage level of said direct current power supply;

means for integrating said voltage excursions to provide an average value of said first signal;

means for varying the frequency of operation of said switching means from at least approximately one-half of said natural frequency of resonance to said natural frequency of resonance in response to said first signal to control the power output of said apparatus when said induction coil means is inductively coupled to a cooking utensil;

control means for providing a manual control signal, said frequency varying means being responsive to both said first signal and said manual control signal, said frequency varying means including means for clamping said switching means, time delay means for establishing a clamp time interval, with said time delay means being responsive to both said first signal and said manual control signal for establishing a time constant in relation to said first and manual control signals, said frequency varying means further including means responsive to said time means and operative with said clamping means for changing the frequency of operation of said switching means in relation to said clamp time interval; and means responsive to said switching means and operative with said time delay means for establishing an overriding time interval when said switching means is inoperative.

3. In an apparatus for heating a cooking utensil by magnetic induction and operative with a direct current power supply, the combination of:

induction coil means adapted to be inductively coupled to a cooking utensil;

series resonant circuit means having a natural frequency of resonance in the ultrasonic range and including said induction coil means;

switching means connected to said direct current power supply for converting direct current power into alternating current power at ultrasonic frequency and for energizing said series resonant circuit means;

means operative with said series resonant circuit means and said direct current power supply for providing a first signal indicative of voltage excursions of said series resonant circuit means under operation beyond the voltage level of said power supply;

means for integrating said voltage excursions to provide an average value of said first signal;

means for providing a manual control signal;

means for controlling the frequency of operation of said switching means in response to said first signal and said manual control signal, said frequency control means including means for clamping said switching means, time delay means for establishing a clamp time interval with said time delay means being responsive to both said first signal and said manual control signal for establishing a time constant in relation to said first signal and said manual signal;

means responsive to said time delay means and operative with said clamping means for changing the frequency of operation of said switching means in relation to said clamp time interval, said means responsive to said time delay means including monostable multivibrator means operative in an unstable mode in relation to said time delay means said monostable multivibrator means being triggered into said unstable mode by said switching means on each half cycle thereof, said clamping means being operative in response to said unstable mode.

4. The apparatus of claim 3 with said manual operated control means having at least a high power setting, a low power setting and a minimum power setting, said lower power setting being in the lower range of the ultrasonic frequency spectrum, and including means operative with said minimum power setting for blocking said monostable multivibrator means in the unstable mode during a second predetermined time interval to reduce the power output of said apparatus beyond the value corresponding to said low power setting, said second time interval extending over a plurality of conduction cycles of said power switches.

* * * * *

UNITED STATES PATENT AND TRADEMARK OFFICE

CERTIFICATE OF CORRECTION

PATENT NO. : 4,085,300

DATED : April 18, 1978

INVENTOR(S) : Raymond W. MacKenzie, Peter Wood, Theodore M. Heinrich an Robert M. Oates It is certified that error appears in the above-identified patent and that said Letters Patent are hereby corrected as shown below:

Column 6, Line 59, (9) of THE SERIES RESONANT POWER CIRCUIT, change "$\alpha_n$" to the Greek symbol -- $\alpha$ --.

Column 7, Line 34, (14) of THE SERIES RESONANT POWER CIRCUIT, change "$e_2$" to -- $e_1$ --.

Column 7, Line 58, (15) of THE SERIES RESONANT POWER CIRCUIT, change "$R' = \frac{\quad}{Q_o \text{ (LOADED)}} = R \frac{\omega Q_o \text{ (LOADED)}}{Q \text{ (UNLOADED)}}$" to -- $R' = \frac{\omega_o L}{Q \text{ (LOADED)}} = R \frac{Q_o \text{ (LOADED)}}{Q_o \text{ (UNLOADED)}}$

UNITED STATES PATENT AND TRADEMARK OFFICE

CERTIFICATE OF CORRECTION

PATENT NO. : 4,085,300

DATED : April 18, 1978

INVENTOR(S) : Raymond W. MacKenzie, Peter Wood, Theodore M. Heinrich and Robert M. Oates It is certified that error appears in the above-identified patent and that said Letters Patent are hereby corrected as shown below:

Column 13, Lines 26 and 27, (24) of DESCRIPTION OF THE INVENTION change "$\frac{4}{\pi}$" to -- $\frac{4}{\pi^2}$ --

Column 15, Line 41, change "transducer" to -- transformer --.

Column 21, Line 54, after the words "further including means responsive to said time" add the word -- delay --.

Signed and Sealed this

*Third* Day of *October 1978*

[SEAL]

*Attest:*

RUTH C. MASON
*Attesting Officer*

DONALD W. BANNER
*Commissioner of Patents and Trademarks*